US010650661B2

(12) United States Patent
Mehregany

(10) Patent No.: US 10,650,661 B2
(45) Date of Patent: May 12, 2020

(54) APPARATUS AND METHOD FOR IMPROVED DRUG DOSING-REGIMEN COMPLIANCE

(71) Applicant: QuantaEd, LLC, San Diego, CA (US)

(72) Inventor: Mehran Mehregany, San Diego, CA (US)

(73) Assignee: QuantaEd, LLC, San Diego, CA (US)

( * ) Notice: Subject to any disclaimer, the term of this patent is extended or adjusted under 35 U.S.C. 154(b) by 0 days.

(21) Appl. No.: 16/385,176

(22) Filed: Apr. 16, 2019

(65) Prior Publication Data

US 2019/0244510 A1 Aug. 8, 2019

Related U.S. Application Data

(63) Continuation-in-part of application No. 16/290,656, filed on Mar. 1, 2019, now Pat. No. 10,431,070, (Continued)

(51) Int. Cl.

| | |
|---|---|
| ***G08B 21/24*** | (2006.01) |
| ***A61J 7/04*** | (2006.01) |
| ***A61J 1/03*** | (2006.01) |

(52) U.S. Cl.

CPC ..... *G08B 21/24* (2013.01); *A61J 1/035* (2013.01); *A61J 7/049* (2015.05); *A61J 7/0418* (2015.05);

(Continued)

(58) Field of Classification Search

CPC ..... G08B 21/24

See application file for complete search history.

(56) References Cited

U.S. PATENT DOCUMENTS

| | | | |
|---|---|---|---|
| D139,383 | S | 11/1944 | Lampl |
| 2,885,110 | A | 5/1959 | Tregilgas |

(Continued)

FOREIGN PATENT DOCUMENTS

| | | | |
|---|---|---|---|
| AU | 2009238236 | A1 | 12/2009 |
| CN | 101802648 | A | 8/2010 |

(Continued)

OTHER PUBLICATIONS

Officer: Jean Sommer, "International Search Report and Written Opinion", PCT/US2016/055516, Completed Jan. 5, 2017.

(Continued)

*Primary Examiner* — Qutbuddin Ghulamali

(74) *Attorney, Agent, or Firm* — Kaplan Breyer Schwarz, LLP

(57) ABSTRACT

A method and apparatus for monitoring adherence to a dosing-regimen for a medication is presented. Systems in accordance with the present invention automatically monitor the medicine content of a blister card based on the state of its lidding film and compare it to the prescribed dosing regimen for the medicine. In some embodiments, the lidding film is imaged using a tomographic imaging technique, such as electrical resistance tomography or electrical impedance tomography. Alternative sensing approaches are based on optical, acoustic, and tactile sensors that interrogate either the dispensing region at each tablet location or the tablets themselves to determine whether tablets have been dispensed. Automatic monitoring of the blister card enables the user to be: (1) alerted to non-compliance, (2) alerted to a risk of future non-compliance, and/or (3) to be provided remediation instructions when non-compliance is determined.

35 Claims, 14 Drawing Sheets

Related U.S. Application Data which is a continuation of application No. 16/100,430, filed on Aug. 10, 2018, now Pat. No. 10,282,971, which is a continuation of application No. 15/223,779, filed on Jul. 29, 2016, now Pat. No. 10,083,594.

(60) Provisional application No. 62/320,234, filed on Apr. 8, 2016.

(52) U.S. Cl.
CPC ..... *A61J 7/0436* (2015.05); *A61J 7/0481* (2013.01); *A61J 2200/30* (2013.01); *A61J 2200/70* (2013.01); *A61J 2205/70* (2013.01)

(56) References Cited

U.S. PATENT DOCUMENTS

| | | | | |
|---|---|---|---|---|
| 3,243,081 | A | 3/1966 | Schmank | |
| 3,854,625 | A | 12/1974 | Kuebler | |
| D253,722 | S | 12/1979 | Allen | |
| D257,584 | S | 12/1980 | Finkel | |
| D275,833 | S | 10/1984 | Malpass | |
| 4,616,316 | A | 10/1986 | Hanpeter et al. | |
| 4,617,557 | A | 10/1986 | Gordon | |
| D305,960 | S | 2/1990 | Wolff | |
| D307,421 | S | 4/1990 | Tedham et al. | |
| D311,774 | S | 10/1990 | Lax | |
| D324,819 | S | 3/1992 | Eisenberg | |
| D339,742 | S | 9/1993 | Walchek, Jr. et al. | |
| 5,267,650 | A | 12/1993 | Gilbilisco | |
| 5,313,439 | A | 5/1994 | Albeck | |
| D358,546 | S | 5/1995 | Walchek, Jr. et al. | |
| D358,762 | S | 5/1995 | Walchek, Jr. et al. | |
| 5,412,372 | A | 5/1995 | Parkhurst et al. | |
| D398,521 | S | 9/1998 | Coe | |
| D399,134 | S | 10/1998 | Lidle, Jr. | |
| 5,852,590 | A | 12/1998 | De La Huerga | |
| D411,445 | S | 6/1999 | Anderson | |
| D414,106 | S | 9/1999 | Anderson | |
| D453,354 | S | 2/2002 | Ikenaga et al. | |
| 6,411,567 | B1 | 6/2002 | Niemiec et al. | |
| D460,690 | S | 7/2002 | Doerschlag | |
| 6,839,304 | B2 * | 1/2005 | Niemiec | A61J 7/0481 206/531 |
| D514,308 | S | 2/2006 | Wahl et al. | |
| D516,801 | S | 3/2006 | Jones et al. | |
| D518,178 | S | 3/2006 | Christiansen | |
| 7,028,723 | B1 | 4/2006 | Alouani et al. | |
| 7,081,807 | B2 | 7/2006 | Lai | |
| 7,113,101 | B2 | 9/2006 | Petersen et al. | |
| D541,039 | S | 4/2007 | Stugelmeyer | |
| 7,258,005 | B2 | 8/2007 | Nyce | |
| D553,738 | S | 10/2007 | Simonson | |
| D585,638 | S | 2/2009 | Skedelius | |
| D593,316 | S | 6/2009 | Ruwiel | |
| D606,393 | S | 12/2009 | Easterbrook et al. | |
| 7,630,788 | B1 | 12/2009 | Reese | |
| D612,594 | S | 3/2010 | Wade et al. | |
| D622,499 | S | 8/2010 | Sprada et al. | |
| 7,821,404 | B2 | 10/2010 | Walker et al. | |
| 7,928,835 | B1 | 4/2011 | Jovanov et al. | |
| D640,920 | S | 7/2011 | Giraud et al. | |
| 8,025,149 | B2 | 9/2011 | Sterry et al. | |
| 8,120,492 | B2 | 2/2012 | Scharfeld et al. | |
| 8,152,020 | B2 | 4/2012 | Flowers et al. | |
| D660,428 | S | 5/2012 | Hohl | |
| D663,110 | S | 7/2012 | Marwah et al. | |
| D663,112 | S | 7/2012 | Fulmer Mason | |
| D665,571 | S | 8/2012 | Tello | |
| D673,360 | S | 1/2013 | Denzinger | |
| D679,086 | S | 4/2013 | Liguori | |
| D689,688 | S | 9/2013 | Horn | |
| D693,999 | S | 11/2013 | Alexander | |
| 8,583,281 | B2 | 11/2013 | Bear et al. | |
| D694,906 | S | 12/2013 | Priebe et al. | |
| 8,733,432 | B2 | 5/2014 | Labrecque | |
| D711,882 | S | 8/2014 | Yeo | |
| D716,868 | S | 11/2014 | Jansen et al. | |
| 8,878,654 | B2 | 11/2014 | Cohen-Alloro et al. | |
| D719,216 | S | 12/2014 | Jansen et al. | |
| 8,960,440 | B1 | 2/2015 | Kronberg | |
| 8,963,710 | B2 | 2/2015 | Huang et al. | |
| D727,903 | S | 4/2015 | Madsen | |
| 9,070,063 | B2 | 6/2015 | Carrender | |
| D736,404 | S | 8/2015 | Priebe et al. | |
| D787,812 | S | 5/2017 | Ganesan et al. | |
| 9,717,654 | B2 | 8/2017 | Dickie et al. | |
| 9,717,655 | B2 | 8/2017 | Nova et al. | |
| 2005/0162979 | A1 | 7/2005 | Ostergaard et al. | |
| 2005/0252924 | A1 | 11/2005 | Pieper et al. | |
| 2009/0283438 | A1 | 11/2009 | Bourque | |
| 2010/0006441 | A1 | 1/2010 | Renaud et al. | |
| 2010/0089789 | A1 | 4/2010 | Rosenbaum et al. | |
| 2010/0094455 | A1 * | 4/2010 | Dehlin | A61J 7/0481 700/232 |
| 2010/0147733 | A1 | 6/2010 | Pabari et al. | |
| 2011/0100862 | A1 | 5/2011 | Turkington et al. | |
| 2012/0024889 | A1 | 2/2012 | Robertson et al. | |
| 2012/0056000 | A1 | 3/2012 | Shores | |
| 2013/0085365 | A1 | 4/2013 | Marashdeh et al. | |
| 2013/0126379 | A1 | 5/2013 | Medhal et al. | |
| 2013/0222135 | A1 | 8/2013 | Stein et al. | |
| 2013/0285681 | A1 * | 10/2013 | Wilson | H05K 1/118 324/693 |
| 2013/0319902 | A1 * | 12/2013 | Tufi | A61J 1/035 206/534 |
| 2013/0330684 | A1 | 12/2013 | Dillon et al. | |
| 2014/0055267 | A1 | 2/2014 | Rothschild | |
| 2014/0118010 | A1 | 5/2014 | Fan et al. | |
| 2014/0251850 | A1 | 9/2014 | Huang et al. | |
| 2014/0255899 | A1 | 9/2014 | Poullain | |
| 2014/0341411 | A1 | 11/2014 | Mohindra et al. | |
| 2015/0286852 | A1 * | 10/2015 | Sengstaken, Jr. | A61J 1/035 340/10.1 |
| 2016/0103085 | A1 | 4/2016 | Mehregany | |
| 2016/0158109 | A1 | 6/2016 | Nova et al. | |
| 2017/0294105 | A1 | 10/2017 | Mehregany et al. | |
| 2018/0044060 | A1 | 2/2018 | Leahy | |

FOREIGN PATENT DOCUMENTS

| | | | |
|---|---|---|---|
| CN | 104302555 | A | 1/2015 |
| EP | 2067718 | A1 | 6/2009 |
| GB | 2463054 | A | 3/2010 |
| WO | 94/07184 | A1 | 3/1994 |
| WO | 2008/079090 | A1 | 7/2008 |
| WO | 2009/116108 | A1 | 9/2009 |
| WO | 2010/045227 | A1 | 4/2010 |
| WO | 2010/108838 | A1 | 9/2010 |
| WO | 2012/111034 | A1 | 8/2012 |
| WO | 2013/159198 | A1 | 10/2013 |
| WO | 2015/191159 | A2 | 12/2015 |

OTHER PUBLICATIONS

Officer: Jean Sommer, "International Search Report", PCT/US2016/055516, Completed Jan. 5, 2017.

Officer: Ioannis Kousouretas, "International Search Report and Written Opinion", PCT/US2016/055535, Completed Jan. 16, 2017.

Officer: Ioannis Kousouretas, "International Search Report", PCT/US2016/055535, Completed Jan. 16, 2017.

Office Action issued in counterpart European patent application No. 17719957.7, dated Aug. 5, 2019, 7 pp.

Ramani Duraiswami et al., "Efficient 2D and 3D electrical impedance tomography using dual reciprocity boundary element techniques", "Engineering Analysis with Boundary Elements", Abstract only, Sep. 21, 1998, Publisher: Elsevier B.V., 13-31, vol. 22, Iss 1, https://doi.org/10.1016/S0955-7997(98)00028-9.

Sarkar et al., "Efficient 2D and 3D electrical impedance tomography using dual reciprocity boundary element techniques", "Engineering Analysis with Boundary Elements", Jul. 1998, Publisher: Research Gate.

(56) References Cited

OTHER PUBLICATIONS

Silva et al., "Influence of current injection pattern and electric potential measurement strategies in electrical impedance tomography", Mar. 2, 2016, Publisher: Elsevier Ltd., Publication: "Control Engineering Practice", http://dx.doi.org/10.1016/j.conengprac.2016.03.003, Country: BR.
Todd O'Connor, "mTouch (TM) Projected Capacitive Touch Screen Sensing Theory of Operation", ISBN:978-1-60932-466-7, Publisher: Microchip Technology Inc., vol. DS93064A, pp. 1-16, Jan. 5, 2010, US.
Yang et al., "A Health-IoT Platform Based on the Integration of Intelligent Packaging, Unobtrusive Bio-Sensor and Intelligent Medicine Box", "Transactions on Industrial Informatics", 2014, pp. 1-13, Publisher: IEEE; DOI: 10.1109/TII.2014.2307795.
Yongjia (Allen) Yao, "Wearable Sensor Scanner using Electrical Impedance Tomography", Sep. 26, 2012, Publisher: University of Bath, Country: UK.
"SMRxT Realtime Medication Adherence", 2012-2014, Publisher: SMRxT Inc.; http://smrxl.com/index.php.
"The Most Accurate Smart Blister in the World", "med-ic Smart Label", 2011, Publisher: IMC Information Mediary Corp.
Advisory Action (PTOL-303) received for U.S. Appl. No. 14/879,874, dated Aug. 1, 2018, 3 pages.
Advisory Action (PTOL-303) received for U.S. Appl. No. 15/170,121, dated Aug. 3, 2018, 4 pages.
Applicant Initiated Interview Summary (PTOL-413) received for U.S. Appl. No. 14/879,874, dated Mar. 13, 2019, 3 pages.
Applicant Initiated Interview Summary received for U.S. Appl. No. 29/614,053, dated Oct. 2, 2018.
Applicant Initiated Interview Summary received for U.S. Appl. No. 14/879,874, dated Jul. 5, 2018, 3 pages.
Applicant Initiated Interview Summary received for U.S. Appl. No. 15/170,121, dated Jul. 5, 2018, 3 pages.
Ariel Bogle, "Soon Your Medicine Bottle Could Remind You to Take Your Pills", "Future Tense—The Citizen's Guide to the Future", Aug. 19, 2013, Publisher: ASU | New America | Slate.
Authorized Officer Shane Thomas, International Search Report and Written Opinion issued in International Patent Application No. PCT/US18/55267 dated Dec. 11, 2018.
Authorized Officer: Gkama, Alexandra, International Search Report and Written Opinion issued in PCT patent application No. PCT/US2018/019289, dated May 16, 2018, 11 pp.
Authorized Officer: Melissa Koval, "International Preliminary Report on Patentability" dated Sep. 1, 2017 in PCT Application No. PCT/US16/55516.
Cielo Pill Holders. Link: https://www.cielopillholders.com/products/slim-single-chamber-pill-holder. Visited Dec. 4, 2018. Slim Single Chamber Pill Holder (Year: 2018).
Examiner initiated interview summary (PTOL-413B) received for U.S. Appl. No. 14/879,874, dated Jun. 3, 2019, 2 pages.
Examiner initiated interview summary (PTOL-413B) received for U.S. Appl. No. 15/170,121, dated Aug. 3, 2018, 1 pages.
Examiner initiated interview summary (PTOL-413B) received for U.S. Appl. No. 29/614,055, dated Dec. 20, 2018, 1 page.
Examiner initiated interview summary received for U.S. Appl. No. 16/290,656, dated Jul. 30, 2019, 1 page.
"Non-Final Office Action", U.S. Appl. No. 14/879,874, dated Oct. 10, 2017.
"Notice of Allowance" issued in related U.S. Appl. No. 15/223,779, dated Apr. 19, 2018.
"Final Rejection" issued in related U.S. Appl. No. 14/879,874 dated May 14, 2018.
"Non-Final Rejection" issued in U.S. Appl. No. 15/170,121, dated Nov. 20, 2017.
"Non Final Office Action" issued in U.S. Appl. No. 15/223,779 dated Sep. 8, 2017.
Office Action issued in counterpart Chinese patent application No. 201780030375.4, dated Jul 3, 2019, 14 pp.
Final Office Action received for U.S. Appl. No. 14/879,874, dated May 14, 2018, 35 pages.
Final Office Action received for U.S. Appl. No. 15/170,121, dated May 29, 2018, 20 pages.
Final Rejection dated May 29, 2018 for U.S. Appl. No. 15/170,121.
Final Rejection received for U.S. Appl. No. 16/179,287, dated Aug. 1, 2019, 11 pages.
Final Rejection received for U.S. Appl. No. 29/614,053, dated Jan. 10, 2019, 5 pages.
Non-Final Office Action received for U.S. Appl. No. 14/879,874, dated Oct. 10, 2017, 29 pages.
Non-Final Office Action received for U.S. Appl. No. 15/170,121, dated Nov. 20, 2017, 17 pages.
Non-Final Office Action received for U.S. Appl. No. 15/223,779, dated Sep. 8, 2017, 13 pages.
Non-Final Rejection dated Feb. 8, 2019 for U.S. Appl. No. 16/179,287.
Non-Final Rejection dated Oct. 10, 2017 for U.S. Appl. No. 14/879,874.
Non-Final Rejection received for U.S. Appl. No. 14/879,874, dated Feb. 26, 2019, 40 pages.
Non-Final Rejection received for U.S. Appl. No. 15/170,121, dated Mar. 7, 2019, 21 pages.
Non-Final Rejection received for U.S. Appl. No. 16/100,430, dated Jan. 25, 2019, 7 pages.
Non-Final Rejection received for U.S. Appl. No. 16/179,287, dated Feb. 8, 2019, 9 pages.
Non-Final Rejection received for U.S. Appl. No. 16/290,656, dated Jun. 28, 2019, 6 pages.
Notice of Allowance and Fees Due (PTOL-85) dated Aug. 9, 2018 for U.S. Appl. No. 15/223,779.
Notice of Allowance and Fees Due (PTOL-85) received for U.S. Appl. No. 14/879,874, dated Jun. 3, 2019, 19 pages.
Notice of Allowance and Fees Due (PTOL-85) received for U.S. Appl. No. 15/170,121, dated Apr. 30, 2019, 14 pages.
Notice of Allowance and Fees Due (PTOL-85) received for U.S. Appl. No. 16/100,430, dated Mar. 13, 2019, 8 pages.
Notice of Allowance and Fees Due (PTOL-85) received for U.S. Appl. No. 29/614,049, dated Jan. 10, 2019, 5 pages.
Notice of Allowance and Fees Due (PTOL-85) received for U.S. Appl. No. 29/614,053, dated Feb. 21, 2019, 5 pages.
Notice of Allowance and Fees Due (PTOL-85) received for U.S. Appl. No. 29/614,055, dated Dec. 20, 2018, 9 pages.
Notice of Allowance received for U.S. Appl. No. 15/223,779, dated Apr. 19, 2018, 8 pages.
Notice of Allowance received for U.S. Appl. No. 15/223,779, dated Aug. 9, 2018, 09 pages.
Notice of Allowance received for U.S. Appl. No. 16/290,656, dated Jul. 30, 2019, 9 pages.
Office Action received for European Patent Application No. 16791135.3, dated Mar. 29, 2019, 4 pages.
Officer: Hong Djien Ong, "International Search Report and the Written Opinion", International Patent Application No. PCT/US2017/025302, Search Completed Jun. 8, 2017, 12 pp.

* cited by examiner

100

APPARATUS AND METHOD FOR IMPROVED DRUG DOSING-REGIMEN COMPLIANCE

STATEMENT OF RELATED CASES

This case is a continuation-in-part of co-pending U.S. Non-Provisional patent application Ser. No. 16/290,656 filed Mar. 1, 2019, which is a continuation of U.S. Non-Provisional patent application Ser. No. 16/100,430 filed Aug. 10, 2018, which is a continuation of U.S. Non-Provisional patent application Ser. No. 15/223,779 (now U.S. Pat. No. 10,083,594), filed Jul. 29, 2016, which claims priority to U.S. Provisional Patent Application Ser. No. 62/320,234 filed on Apr. 8, 2016, each of which is incorporated herein by reference.

BACKGROUND OF THE INVENTION

Many prescription and over-the-counter medicines (a.k.a., drugs) require adherence to a specific dosing regimen (i.e., dosing-regimen compliance) that dictates the amount of medicine administered (i.e., dosage) each time it is provided to a user, the frequency with which it is administered to the user (dosing interval), and a recommended time frame around each dosing interval (dosing window) in which the medicine should be administered to the user. Unfortunately, dosing-regimen noncompliance is common and leads to a costly problem in many ways, from driving up health care costs to financial losses to the pharmaceutical industry to serious negative human impacts:

- 125,000 people die in the US each year as a result of failure to adhere to dosing regimens for prescription drugs;
- Studies reflect $290 billion per year of healthcare implications of dosing-regimen non-compliance;
- The global pharmaceutical market loses an estimated $564 billion annually, or 59% of the $956 billion in total global pharmaceutical revenue in 2011 due to dosing-regimen non-compliance;
- In developed countries, adherence to long-term therapies in the general population is around 50%, and much lower in developing countries; and
- Nearly three out of four Americans are not taking their medications as directed—which results in serious health consequences, especially for people with chronic diseases.

The need to properly follow a dosing regimen for a prescription drug is particularly acute for oral contraceptive pills (OCP). For example, in addition to the above issues, failure to follow the proper dosing regimen for OCP has already led to countless unwanted pregnancies and could lead to many more. OCP is one of the most popular forms of contraception, particularly among young women. A government report published Oct. 18, 2012 provides the following statistics for the U.S.:

- Sixty-two percent of women of reproductive age are currently using contraception. Of women using a contraceptive method in the month of the interview, the most common methods used are the pill (28%, or 10.6 million women) and female sterilization (27%, or 10.2 million women). Use of intrauterine devices as a current method has increased since 1995 (from 0.8% in 1995 to 5.6% in 2006-2010), whereas fewer women report that their partners are using condoms as their current, most effective contraceptive method. Of women at risk of an unintended pregnancy, 11% report not currently using a method of contraception.

A United Nations report published in 2011 provides the follow statistics worldwide:

- In developed countries as a whole, the most commonly used methods are the pill (used by 18 percent of women of reproductive age who are married or in a union) and the male condom (with 18 percent prevalence). Those two methods accounted for half of all contraceptive use in the developed countries. By contrast, in developing countries the methods with the highest prevalence were female sterilization (21 percent) and the IUD (15 percent), accounting together for 58 percent of overall contraceptive use.

Failure to take a pill is one of the main reasons for seeking emergency contraception (e.g., the morning after pill) in women relying on OCP. A primary cause of unintended pregnancy in these women may therefore be poor dosing-regimen compliance. Studies suggest that as much as 47% of women worldwide show poor adherence to the prescribed dosing regimen, missing two or more pills per cycle. (A menstrual cycle is on average 28 days.) Britain's largest manufacturer of OCP, Schering Health Care Ltd, reports that on average women forget to take their pill eight times a year. Most know they have to take remedial steps when they miss a pill, but few know what. Only 10% know missing just one pill places them at risk of pregnancy.

The success of OCP is tightly coupled to adherence to its prescribed dosing regimen, i.e., taking the right pill on the right day during a woman's menstrual cycle. For this reason, birth control pills are packaged in blister cards on which a calendar is printed to guide the patient on which pill to take on which day. Furthermore, the recommended dosing interval, from day to day, is 24 hours and each days dose should be taken within the same time frame within the day. In other words, each day includes a recommended dosing window. For this reason, many use daily reminders (e.g., on mobile devices) to help stay compliant. When a patient becomes non-compliant, the manufacturer recommends specific steps to regain compliance and reduce chances of unintended pregnancy in the interim. Unfortunately, the recommended mediation approaches are not always followed correctly, leading to higher risk of unwanted pregnancy.

A packaging approach that provides one or more of improved patient adherence/compliance, treatment results, authentication, and packaging and distribution approaches would be a welcome advance for the pharmaceutical industry and have particular benefit in the realm of OCP dosing-regimen compliance, as well as dosing regimens for other prescription or over-the-counter drugs.

SUMMARY OF THE INVENTION

The present invention enables tracking of adherence to dosing regimens for prescription and/or over-the-counter medications (e.g., medicinal prescription dosing regimens, etc.) through connected, smart packaging. Embodiments of the present invention are particularly well suited for improving adherence to dosing regimens for oral contraceptive pill prescriptions.

Embodiments of the present invention enable the state of a blister card to be automatically monitored, which enables adherence to a dosing regimen to be tracked and/or improved. Automatic monitoring enables the state of the blister card to be periodically compared to the state that is expected based on the dosing regimen. When a deviation, or risk of deviation from the anticipated dosing regimen is determined, an alert can be issued to the user and/or her care circle. Furthermore, in some embodiments, the user is provided remediation instructions if remediation is possible.

An illustrative embodiment of the present invention is a package comprising a housing that includes a detection module and an electronics module. The detection module is configured to determine the state of a blister card by imaging a monitoring region of its lidding film via electrical resistance tomography. When the blister card is located in the housing, the blister card and a plurality of terminals on the detection module are electrically coupled such that the terminals are in electrical communication with each other through the monitoring region. The monitoring region is periodically imaged and its current state is compared to a previous state to determine whether a change in its conductivity map has occurred during the intervening period. When a tablet is dispensed, it is pushed through the lidding film, thereby forming a hole in the monitoring region that manifests as a feature on the conductivity map. The location of the feature indicates which tablet was dispensed.

At the end of each dosing window of the dosing regimen, the state of the lidding film is compared to its expected state at that point in the dosing regimen. If there is a deviation in the state of the lidding film from what is expected, an error is detected and an alert is issued to the user and/or one or more designated persons in the care circle of the user (e.g., caregiver, nurse, doctor, clinic/hospital, parent, partner, relatives, friends, etc.).

In some embodiments, the package includes a detection module that employs a sensing technique other than tomographic imaging, such as capacitive, optical, acoustic, or tactile sensing.

In some embodiments, the package is configured to provide guidance that fosters good adherence to the prescribed dosing regimen and better management of the efficacy requirements.

In some embodiments, the history of dispensing events and any errors (i.e., noncompliance) in the dispensing history are recorded and saved in a data-storage system.

In some embodiments, a calendar containing events for the user is accessed to assess the risk that a dosing window will coincide with an eminent event that occurs during the time frame of the dosing regimen. In some cases, the geolocations of the event and the blister pack are compared and a determination is made of the risk that the user will not be able to access the blister pack during an upcoming dosing window. When the risk of such future non-compliance is identified, a warning is issued to the user to alert her to this risk so she can take steps to mitigate the risk.

An embodiment in accordance with the present disclosure is a method for monitoring compliance of a user to a dosing regimen for a prescription that includes a plurality of tablets included in a blister card that includes a forming film and a lidding film that is unpatterned, the forming film and lidding film collectively defining a plurality of reservoirs for holding the plurality of tablets, wherein each tablet has a corresponding dosing window that starts at a dosing-window start time and ends at a dosing-window end time, the method comprising: providing a package that includes a detection module and a receiver for locating the blister card such that it is operatively coupled with the detection module; operatively coupling the detection module and the blister card, the detection module being configured to monitor the state of the blister card; monitoring the state of the blister card; performing a first comparison of a first state of the blister card at a first time and an expected state of the blister card at the first time, the expected state being based on the dosing regimen; and generating a first output signal based on the first comparison, wherein the first output signal has a first characteristic when the first comparison indicates compliance with the dosing regimen and a second characteristic when the first comparison indicates non-compliance with the dosing regimen.

Another embodiment in accordance with the present disclosure is a method for monitoring compliance of a user to a dosing regimen for a prescription that includes a plurality of tablets included in a blister card that includes a forming film and a lidding film that is unpatterned, the forming film and lidding film collectively defining a plurality of reservoirs for holding the plurality of tablets, wherein each tablet has a corresponding dosing window that starts at a dosing-window start time and ends at a dosing-window end time, the method comprising: for each of a plurality of first times, t(i), where i is equal to 1 through N and N is the number of tablets in the blister card: (i) determining a first state of the blister card by forming image(i) of the lidding film via a tomographic technique selected from the group consisting of electrical resistance tomography and electrical impedance tomography; (ii) performing a first comparison of the first state at t(i) and an expected state of the blister card at t(i), wherein the expected state is based on the dosing regimen; and (iii) generating a first output signal based on the first comparison, wherein the first output signal has a first characteristic when the first comparison indicates compliance with the dosing regimen and a second characteristic when the first comparison indicates non-compliance with the dosing regimen.

DETAILED DESCRIPTION

The present invention is directed, in part, to connected-packaging solutions for pharmaceutical products, with a focus on medicine containers comprising blister cards. It should be noted that, although the focus of the instant Specification is on OCP, the teachings of the present disclosure can be directed to any medication compliance application—particularly those that are significantly affected by the quality of dosing-regimen compliance, as well as a wide range of other blister-card-based packaged products. For the purposes of this Specification, including the appended claims, the term "tablet" is defined to mean any and all variety of medication, which includes, without limitation, pills, capsules, powder, gel-caps, and the like. Some of the embodiments described herein draw on concepts developed for connected packaging solutions directed to "blister cards," which are described in U.S. patent application Ser. No. 14/879,874, entitled "Connected Packaging," which was filed Oct. 9, 2015, and which is incorporated herein by reference. Furthermore, some embodiments described here draw on concepts developed for connected packaging solutions described in U.S. patent application Ser. No. 15/170,121, entitled "Connected Pharmaceutical Packaging," which was filed Jun. 1, 2016, and which is also incorporated herein by reference.

Figure 1:
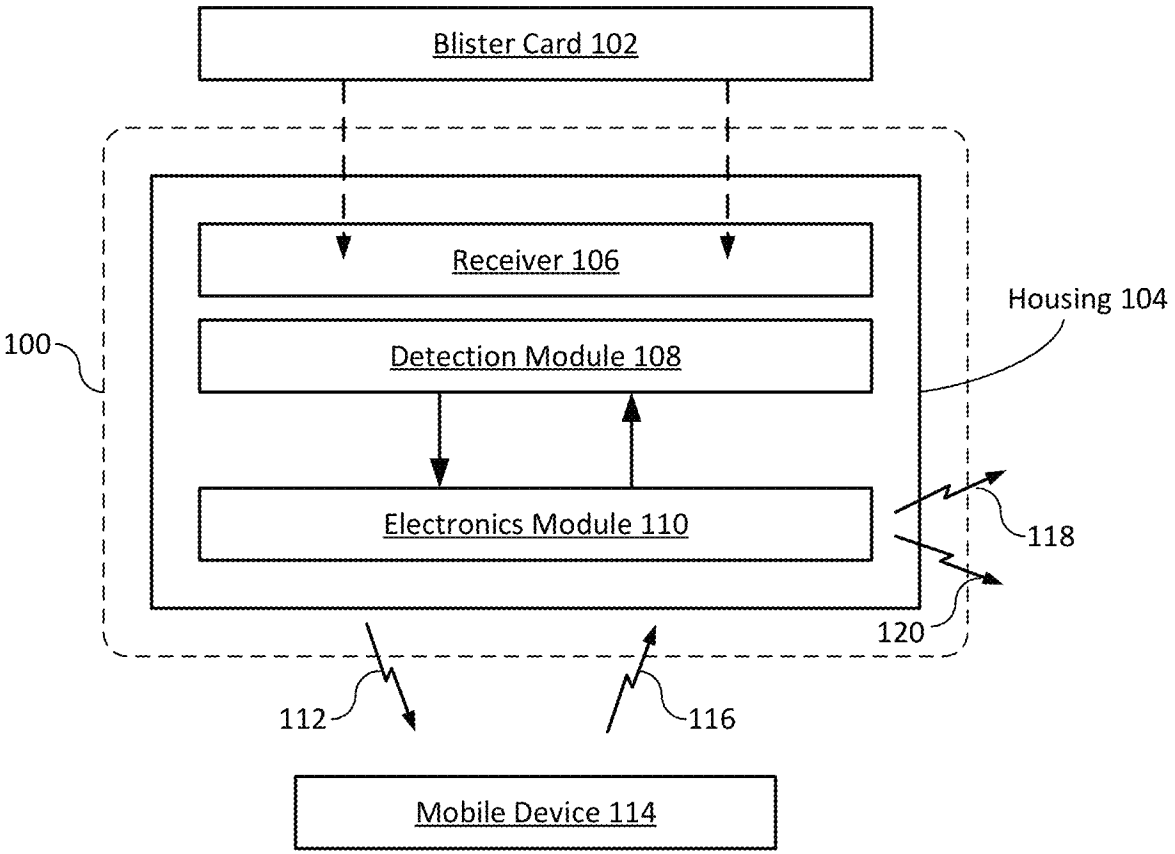
FIG. 1 depicts a block diagram of an illustrative embodiment of a package in accordance with the present disclosure.

FIG. 1 depicts a block diagram of an illustrative embodiment of a package in accordance with the present disclosure. Package 100 is an oral-contraceptive protective case that includes smart-packaging capability, which enables it to monitor the state of OCP blister card 102, enable tracking of adherence to the dosing regimen for the tablets it contains, initiate messages to a user for whom the tablets are prescribed and/or caregivers, and the like. Package 100 includes housing 104, receiver 106, detection module 108, and electronics module 110. Package 100 is dimensioned and arranged to accept a conventional "push-through-pack" blister card comprising a twenty-eight-day dosage of oral contraceptive tablets and locate the blister card such that it is operatively coupled with the detection module.

Package 100 is typically configured to communicate with another device associated with the user, where the package and the device are electronically paired to enable communication between them. However, in some embodiments, package 100 is configured to communicate directly with the user via an interface known in the art (e.g., optical and/or audible signals, an alphanumeric display, a touch-screen, etc.). In the depicted example, package 100 is electronically paired with mobile device 114, which is a conventional mobile phone associated with the user. Mobile device 114 is configured to run one or more software applications (commonly referred to as 'apps' in the art) that provide assistance to the patient and/or their caregiver to promote good adherence to the prescribed dosing regimen.

Figure 2A:
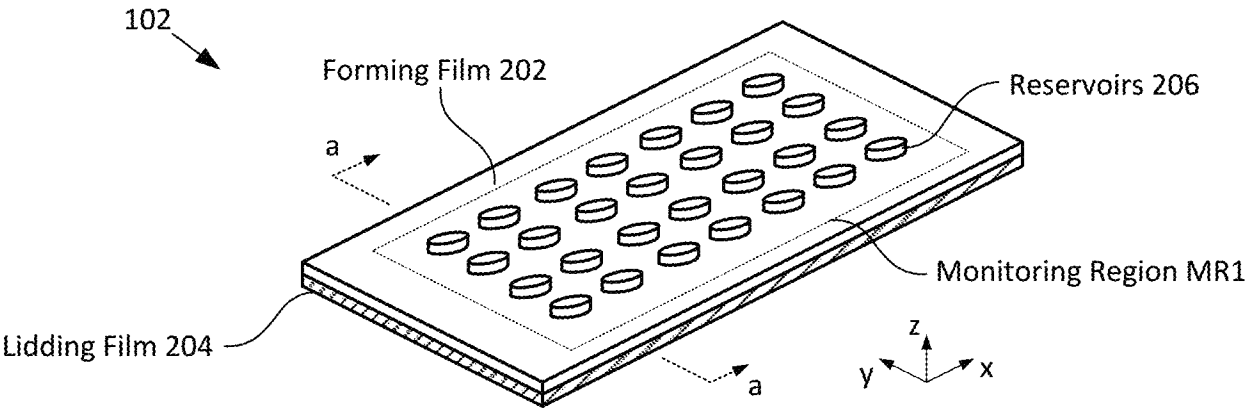
FIGS. 2A-B depict schematic drawings of perspective and cross-sectional views, respectively, of blister card 102.
Figure 2B:
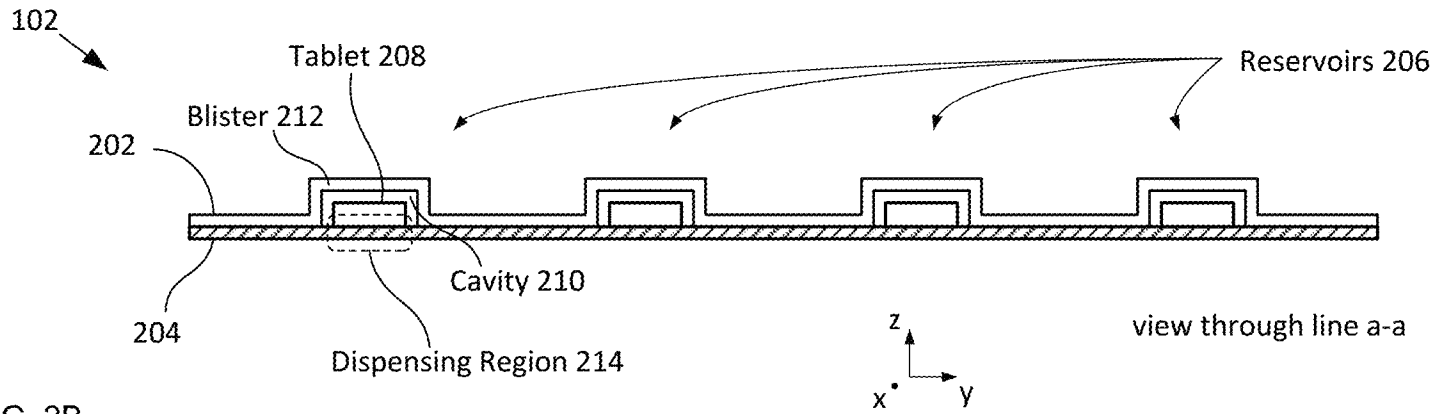

FIGS. 2A-B depict schematic drawings of perspective and cross-sectional views, respectively, of blister card 102. Blister card 102 is a conventional blister card that includes forming film 202, lidding film 204, reservoirs 206, and tablets 208.

Forming film 202 is a layer of thermoformed plastic in which blisters 212 are formed, thereby defining cavities 210.

Lidding film 204 is a thin sheet of aluminum foil. In some embodiments, lidding film 204 is a sheet of another electrically conductive material. In some embodiments, lidding film 204 includes a sheet of conductive material and a sheet of electrically insulating material, such as a paper sheet (with a printed calendar or instructions), polymer, etc. After tablets 208 are dispensed into cavities 210, lidding film 204 is joined with forming film 202 to seal the cavities, thereby completing reservoirs 206. Typically, a calendar that describes the dosing regimen is printed on the card and/or otherwise provided as part of the blister card.

The portion of lidding film 204 located under each cavity defines a dispensing region 214, through which its respective tablet 208 is dispensed by pushing on the blister of its reservoir and forcing the tablet through that lidding foil portion.

Monitoring region MR1 denotes the portion of lidding film 204 that contains all of the dispensing regions of blister card 102. Monitoring region MR1 is usually slightly smaller than the entire extent of the lidding film.

Figure 3:
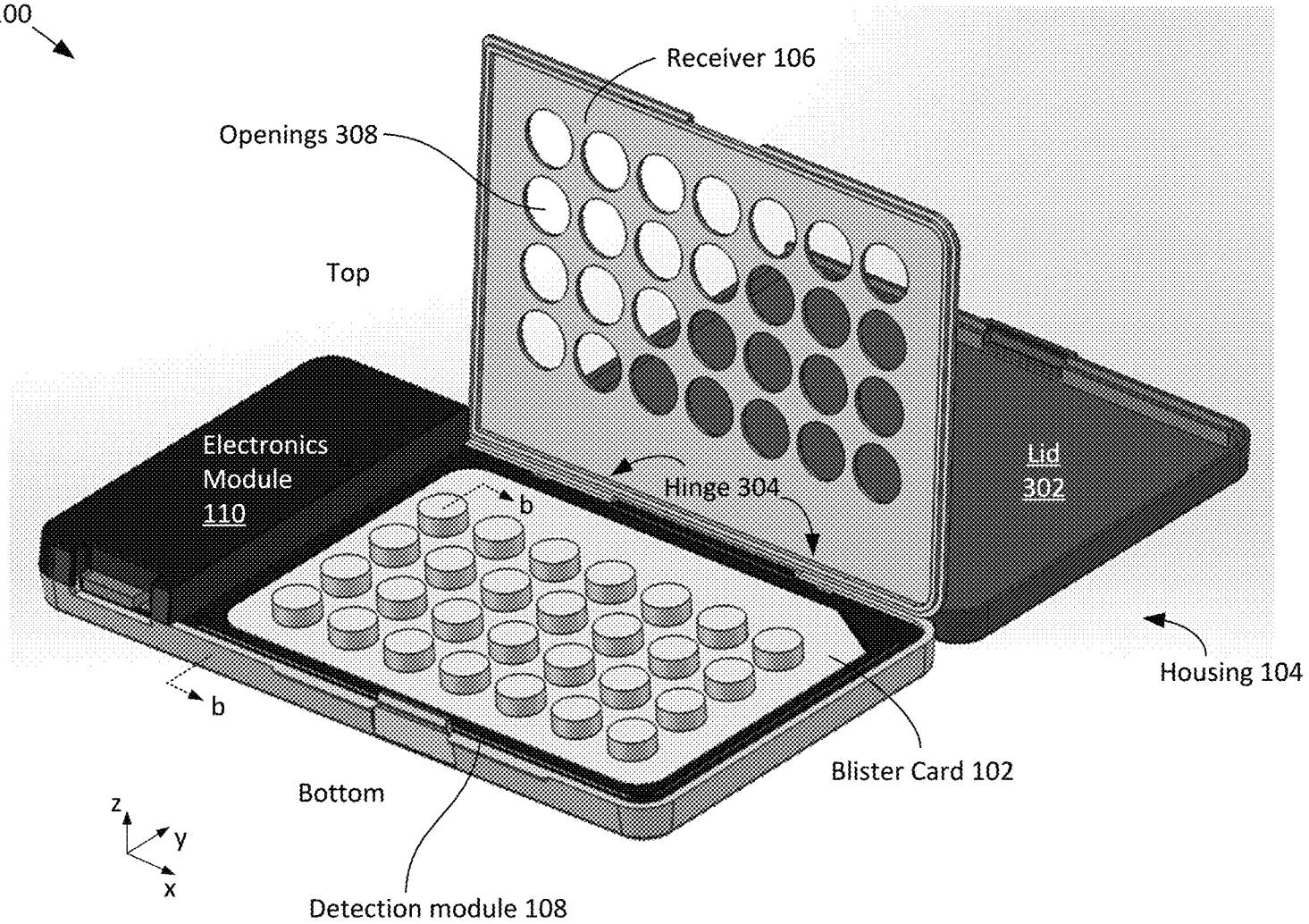
FIG. 3 depicts a schematic drawing of a perspective view of package 100 with blister card 102 installed.

FIG. 3 depicts a schematic drawing of a perspective view of package 100 with blister card 102 installed.

Housing 104 is typically an injection-molded plastic case having sufficient strength to protect blister card 102 and tablets 208.

Receiver 106 includes a rigid frame that is configured to rotate between (1) an unclamped orientation in which it is open, thus enabling a blister card to be inserted or removed from package 100, and (2) a clamped orientation in which it is closed over a blister card to securely locate the blister card against detection module 108, thereby inhibiting a change in the positional relationship between them over the lifetime of the blister card. Receiver 106 includes openings 308, which expose reservoirs 206 and help properly position the blister card against detection module 108. To locate blister card 102 in housing 104, the blister card is typically positioned within a seat formed in the bottom of housing 104 (not shown in FIG. 3) and receiver 106 is closed over the blister card to trap it in place against the seat. As discussed below and with respect to FIGS. 4A-B, in the depicted example, receiver 106 is dimensioned and arranged to provide distributed pressure over the surface of the blister card to securely hold lidding film 204 against detection module 108 such that they are operatively coupled.

In some embodiments, blister card 102 includes printed information on its forming-film side. In such embodiments, those package components that overlay such printed information (e.g., receiver 106) would be made of optically transparent material.

In some embodiments, receiver 106 comprises a different conventional latching system for locating a blister card in housing 104 such that it is operably coupled with detection module 108.

Figure 4A:
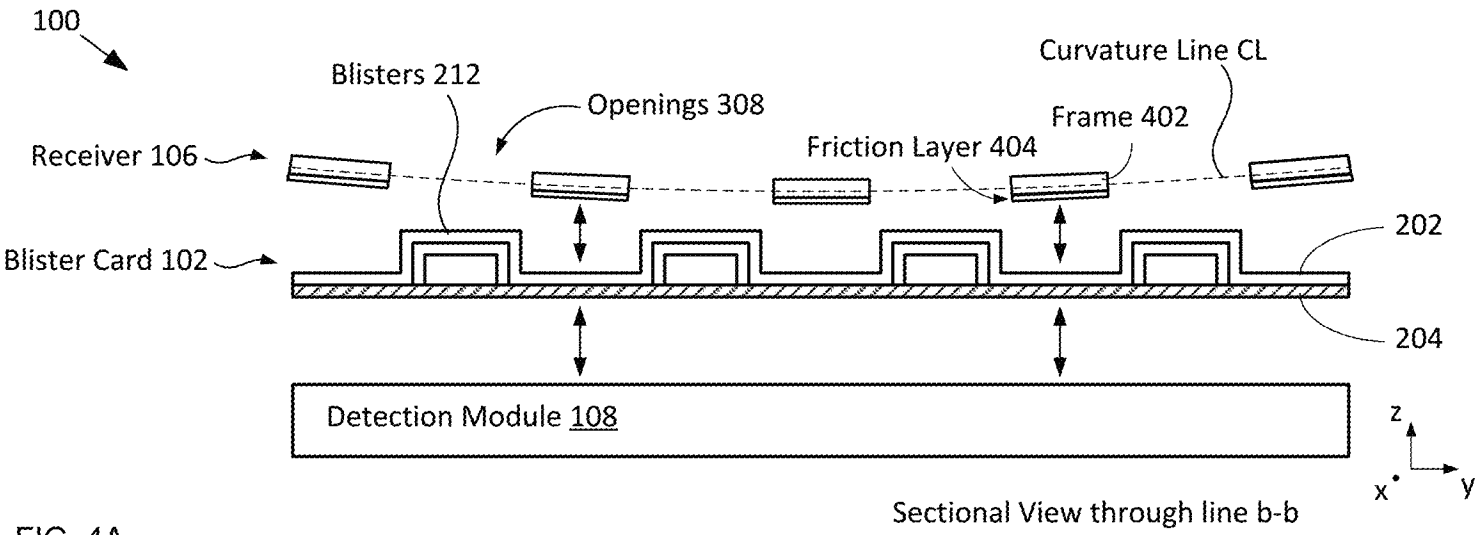
FIGS. 4A-B depict schematic drawings of a receiver in accordance with the illustrative embodiment in decoupled and coupled relationship, respectively, with a blister card and detector module.
Figure 4B:
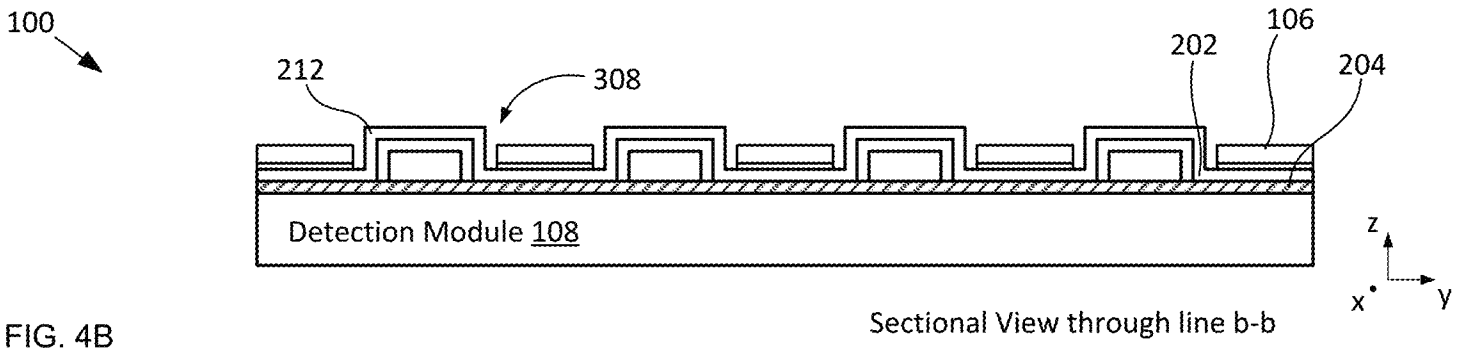

FIGS. 4A-B depict schematic drawings of a receiver in accordance with the illustrative embodiment in decoupled and coupled relationship, respectively, with a blister card and detector module. The sectional views depicted in FIGS. 4A-B are taken along line b-b of FIG. 3. Receiver 106 comprises frame 402 and friction layer 404.

Frame 402 is a substantially rigid plate that is includes openings 302. Frame 402 is configured to rotate between (1) an unclamped orientation, in which the receiver is open such that blister card 102 can be easily inserted or removed, and (2) a clamped orientation in which the receiver is closed such that it can securely locate and hold blister card 102 in a desired position against detection module 108. Typically, frame 402 is held in its clamped orientation via a latch (not shown) formed as part of the bottom portion of housing 102.

In the depicted example, frame 402 is formed such that it has a curvature in the y-direction along curvature line CL when receiver 106 is in its unclamped orientation. The curvature of frame 402 provides it with a mechanical pre-bias that gives rise to a "spring-like" force that is distributed substantially evenly over the surface of blister card 102 when the frame is rotated into its clamped orientation against the blister card 102. As a result, frame 402 presses the blister card against detection module 108, thereby inhibiting relative motion between the blister card and detection module over the lifetime of the blister card. In the depicted example, frame 402 has no curvature along the x-direction; however, in some embodiments, frame 402 has a curvature along both the x- and y-directions. In some embodiments, frame 402 has no mechanical pre-bis and is substantially flat when it is in its unclamped orientation.

It should be noted that in some embodiments, each of the top surface of detection module 108 and lidding film 204 of blister card 102 are low-friction, hard surfaces. As a result, relative motion between these surfaces can occur due to slippage of the blister card in response to environmental stimuli, such as shock and/or vibration.

In the depicted example, receiver 106 includes optional friction layer 404, which is disposed on the bottom surface of frame 402. Friction layer 404 is configured to further inhibit any change in the positional relationship between the detection module and the blister card by enhancing the friction between lidding film 202 and frame 402. Friction layer 404 is a layer of resilient material, such as rubber, gel, etc. In some embodiments, the material of friction layer 404 is also tacky, which further enhances the friction between the blister card and the frame. In some embodiments, friction layer 404 is disposed on at least a portion of the top surface of detection module 108. In such embodiments, friction layer 404 is preferably very thin so that it does not impede operative coupling between the detection module and the lidding film of the blister card.

In some embodiments, friction layer 404 comprises one or more sharp ridges or features that are configured to embed in the relatively soft material of forming film 202 when receiver 106 is latched in its closed position.

In the illustrative embodiment, blister card 102 is located by receiver 106 such that it abuts terminals (not shown) disposed on the top surface of detection module 108, as discussed below.

Figure 4C:
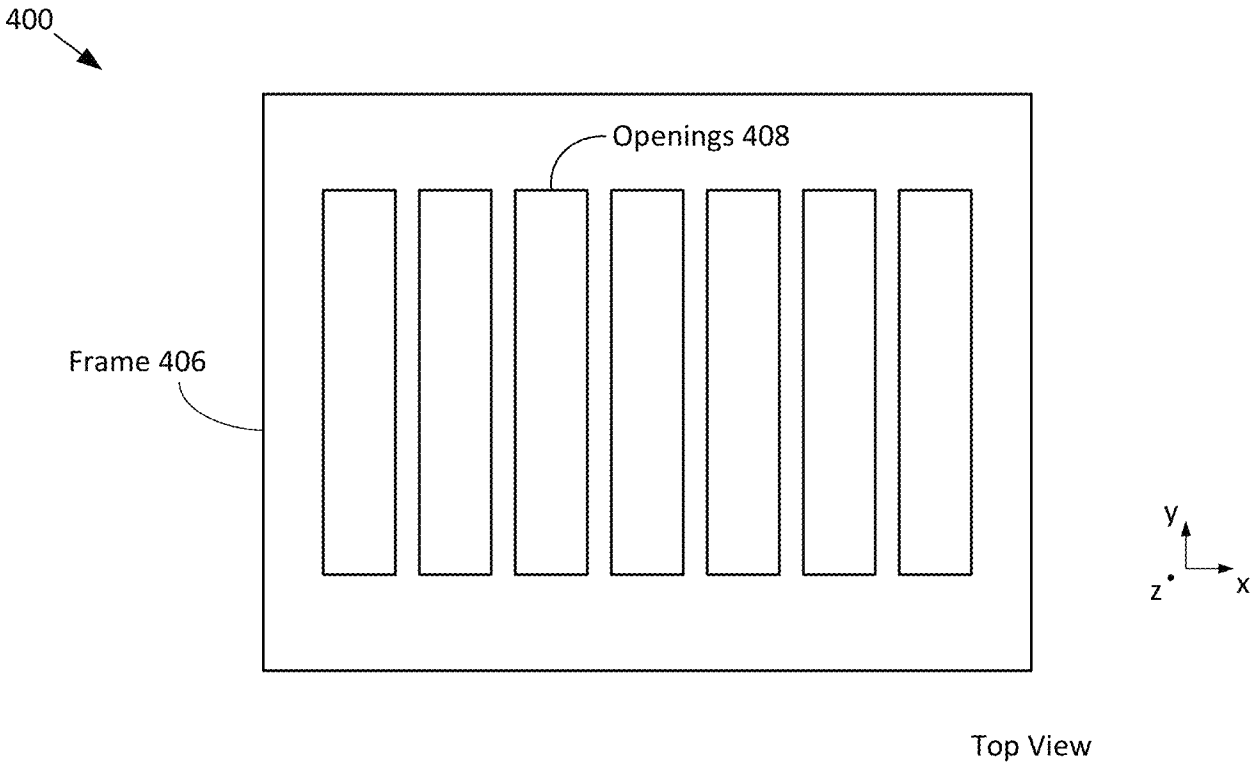
FIG. 4C depicts a schematic drawing of a top view of an alternative receiver in accordance with the present disclosure.

FIG. 4C depicts a schematic drawing of a top view of an alternative receiver in accordance with the present disclosure. Receiver 400 includes frame 406 and openings 408.

Frame 406 is analogous to frame 402.

Openings 408 are analogous to openings 308; however, openings 408 are configured to surround an entire column of reservoirs 212 of blister card 102, while simultaneously reducing mechanical coupling of energy applied to one reservoir to adjacent reservoirs.

It should be noted that there are myriad ways to form a receiver without departing from the scope of the present disclosure, and that the receivers depicted in FIGS. 4A-C are merely examples of receivers suitable for use with the present invention. Examples of alternative receivers suitable for use in accordance with the present disclosure are described in more detail in parent application U.S. Non-Provisional patent application Ser. No. 16/290,656.

Figure 5A:
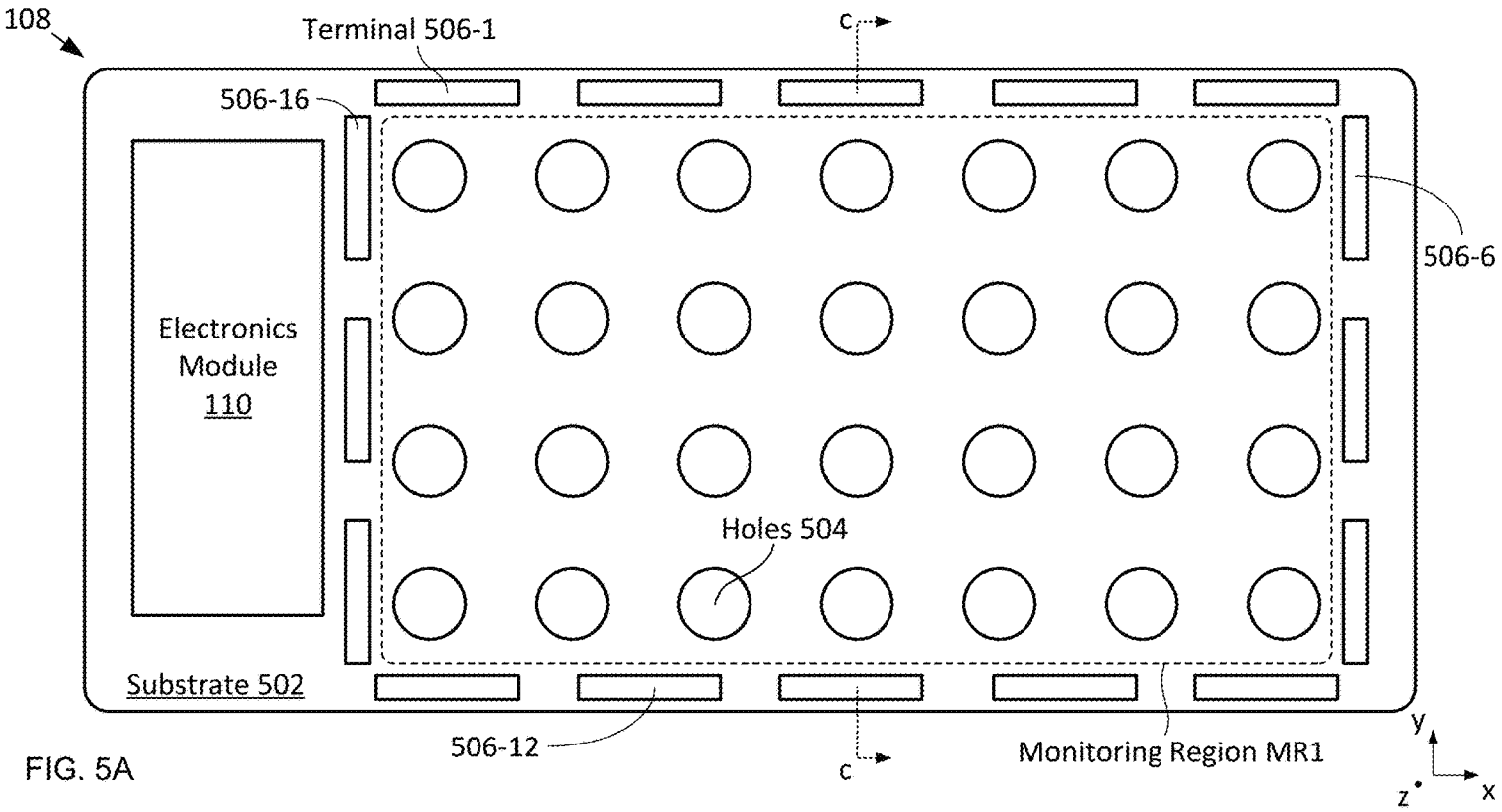
FIGS. 5A-B depict schematic drawings of top and sectional views, respectively, of a detection module in accordance with the illustrative embodiment.
Figure 5B:
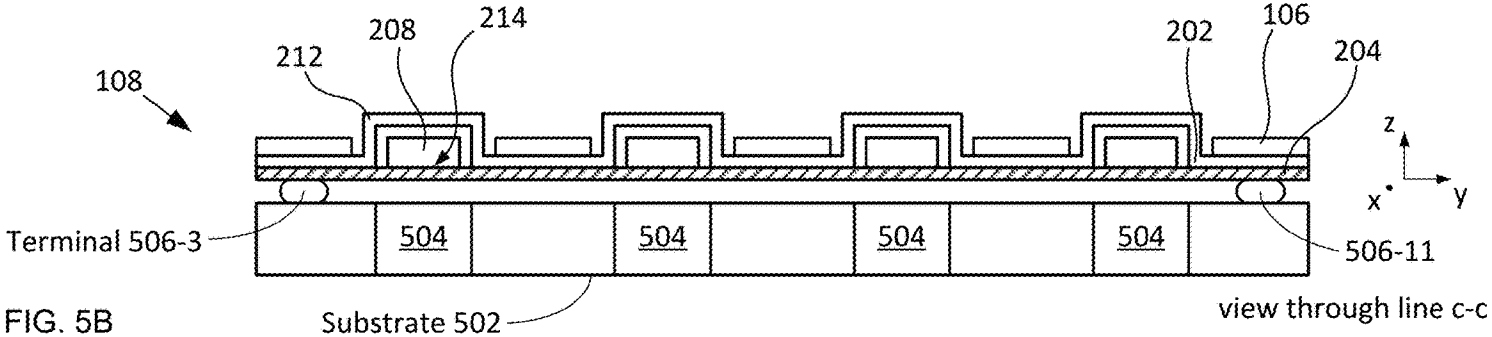

FIGS. 5A-B depict schematic drawings of top and sectional views, respectively, of a detection module in accordance with the illustrative embodiment. FIG. 5A shows detection module 108 without blister card 102 in place, while FIG. 5B shows the detection module in an operatively coupled relationship with blister card 102. Detection module 108 comprises substrate 502, holes 504, and terminals 506-1 through 506-16, which are configured to enable tomographic imaging of a lidding film with which the terminals are electrically coupled.

Substrate 502 is a mechanically robust plate configured to fit in housing 104 and function as the bottom of package 100. Typically, substrate 502 is held in housing 104 via a receiver that is analogous to receiver 106 described above. In the depicted example, substrate 502 is a conventional PCB substrate; however, in some embodiments, substrate 502 is another substrate, such as a semiconductor wafer suitable for planar processing, and the like. In some embodiments, instead of a rigid substrate, detection module 108 comprises a substrate that is flexible and optionally visually transparent, as discussed below and with respect to FIGS. 10A-B.

Holes 504 extend through substrate 502 to enable tablets 208 to pass through detection module 108 when they are dispensed from blister card 102.

Each of terminals 506-1 through 506-16 (referred to, collectively, as terminals 506) is an electrically conductive contact disposed on substrate 502 and configured to make electrical contact with lidding film 204 when blister card 102 is located in housing 104. As a result, each of terminals 506 is in electrical communication with all other terminals 506 through lidding film 204. Terminals 506 are electrically connected to electronics module 110 via electrical traces (not shown). Preferably, the terminals are configured such that blister card 102 is pressed against substrate 202 when the blister card is located by receiver 106, or when pressure is applied to a blister 212, thereby facilitating localized rupture of the dispensing region of its respective reservoir to dispense a tablet. In some embodiments, terminals 506 are formed directly on a surface of the bottom of housing 104, thereby obviating substrate 502.

Terminals 506 are arranged in a pattern that surrounds monitoring region MR1 when blister card 102 is properly located by receiver 106. As a result, as discussed below, terminals 506 enable the use of electrical resistance tomography (ERT) imaging for determining the state of the monitoring region. Preferably, monitoring region MR1 encompasses the entirety, or nearly the entirety, of lidding film 204.

In some embodiments, direct electrical connection between the lidding film and terminals 506 is not possible (such as when the lidding film has a non-conductive layer over at least some portion of its bottom surface). In such embodiments, terminals 506 are capacitively coupled with lidding film 204 and electrical impedance tomography (EIT) imaging is used to determine the state of the monitoring region.

EIT and ERT imaging techniques are described herein and in U.S. patent application Ser. Nos. 14/879,874, 15/170,121, 16/290,656 (the parent application to the instant application), 16/100,430, 15/223,779, and 62/320,234, each of which is incorporated herein by reference.

It should be noted that, although the depicted example includes a detection module configured to determine the state of a blister card via tomographic imaging, myriad alternative sensing technologies can be exploited for determining the state of the lidding film of a blister card without departing from the scope of the present disclosure, including, without limitation, capacitive sensing, acoustic sensing, optical sensing, thermal, and tactile sensing.

Electronics module 110 is an electronics package that is operatively coupled with detection module 108. Electronics module 110 comprises electronic circuitry suitable for interfacing with the sensors of the detection module, signal-conditioning and processing electronics for receiving the output signals of each sensor, output electronics for providing output signal 112, and the like. In some embodiments, electronics module 110 includes, without limitation:

i. communications electronics (wired and/or wireless); or
ii. sensor interface and/or signal conditioning capabilities; or
iii. computation and/or logic capabilities; or
iv. data-storage capabilities (e.g., memory, etc.); or
v. onboard clock circuitry; or
vi. energy storage and/or energy-scavenging electronics; or
vii. sleep-mode and wake-up detection circuitry (e.g., low-power accelerometers, touch/proximity sensors, etc.) to facilitate long battery life between charges such that sensing is activated only when desired, while the package is normally in sleep mode; or
viii. on-package visual and/or audible alerts; or
ix. environmental (e.g., temperature, humidity, shock, geolocation, etc.) sensors; or
x. circuitry for monitoring the geolocation of the package to enable, for example, tracking chain of custody, determination of the distance between mobile device 114 and package 100, etc.; or
xi. circuitry for monitoring of the distance between the package and mobile device 114; or
xii. provision of adherence-status feedback on the package itself and/or through a mobile app on mobile device 114; or
xiii. one or more touch and/or alphanumeric displays, typically disposed on housing 104, to enable display of information regarding blister pack 102 (e.g., prescription identification, dosing-regimen information, identification codes, etc.) and/or direct interaction with the user via displayed text, graphics, user input, and the like; or
xiv. any combination of i, ii, iii, iv, v, vi, vii, viii, ix, x, xi, xii, and xiii.

In some embodiments, long battery life between charges is particularly desirable. As a result, electronics 110 includes a sleep/wake-up mechanism that activates sensing only when needed and the instrument remains in sleep mode most of the time. In some such embodiments, this is achieved by incorporating a low-power accelerometer that, in some cases, is operatively coupled with a touch/proximity sensor. The accelerometer provides a first stage wake-up signal that then activates the touch sensing. The touch/proximity sensing is implemented using capacitive sensing on at least one of detector module 108, electronics module 110, and housing 104. In some embodiments, for example, at least some of one of the top and bottom surfaces of substrate 502 is used for this purpose. This combination of movement and touch/proximity detection reduces false wake-ups, saving power. In some embodiments, the battery life of package 100 is increased further by including energy-scavenging capability in electronics module 110.

In the depicted example, electronics module 110 communicates with mobile device 114 wirelessly via output signal 112 and input signal 116.

One skilled in the art will recognize, after reading this Specification, that the design features of housing 100 are based on the particular arrangement of blister card 102, as well as the sensing technology used to monitor its state. As a result, the design details provided herein are merely exemplary and that myriad alternative designs are possible without departing from the scope of the present invention.

In the package configuration depicted in FIG. 3, detection module 108 and electronics module 110 are assembled on the same substrate using conventional hybrid integration techniques, and the substrate is embedded into the bottom surface of housing 104. In some embodiments, detection module 108 and electronics module 110 are disposed on different substrates. In some embodiments, detection module 108 and electronics module 110 are monolithically integrated on a common substrate. Furthermore, it should be noted that there are numerous ways to integrate detection module 108 and/or electronics module 110 into housing 104 without departing from the scope of the present disclosure. In some embodiments of the present invention, for example, detection module 108 is embedded into the bottom of housing 104, while electronics module 110 is mounted on or in lid 302. Electrical interconnects (not shown) embedded in housing 104 run through hinge 304 to electrically couple the detection and electronics modules. Alternatively, detection module 108 and electronics module 110 are both part of lid 302. In another embodiment, housing 104 includes an extra compartment to house electronics module 110. In some embodiments, detection module 108 and electronics module 110 are disposed in or on one or more printed circuit boards (PCBs) that are mounted in housing 104.

It should be noted that, although this disclosure provides electronics/sensing/display functionality by locating appropriate electronics, etc., in or on housing 104, some or all of such functionality can be provided via integration into the blister card itself without departing from the scope of the present invention.

Numerous mobile-phone- and computer-based apps for improving OCP dosing-regimen compliance through automatic calendar reminders are known in the prior art. These apps typically provide features for manually tracking adherence to a dosing regimen and some level of management of the efficacy requirements, as well as outline the basic methodology for helping achieve and maintain good dosing-regimen compliance and manage the efficacy requirements. A basic limitation of such prior-art mobile apps, however, is the need to manually input all of the necessary data falls to the user because presently available approaches do not have a capability to automatically capture actual dosing-regimen-adherence data. As a result, prior-art OCP apps are tedious to use, are often incorrectly used, and are most effective only for very motivated patients.

Furthermore, while automated systems for tracking dosing-regimen compliance are known, these are typically directed toward medication packaged in bottles. Some conventional systems incorporate wireless connectivity and sensors to monitor and communicate dosing-regimen-compliance data in an accompanying mobile app and/or network servers. If a dose is missed, the system provides a reminder alert automatically, either by an indicator on the system itself or sent to the care circle of the user via an automated call or text message. The ability to automatically generate a reminder message represents an important step in supporting good adherence to a dosing regimen; however, such bottle-centric automated systems are not well suited to use with blister cards (the most common packaging used for OCP prescriptions) and are too cumbersome to be conveniently carried by the user so that they are substantially always available to the user.

It is an aspect of the present invention that the ability to automatically detect and record dispensing events for a bister card enables improved methods for assisting the user to adhere to a dosing regimen for a medication. In addition, approaches in accordance with the present disclosure enable passive tracking of dosing-regimen compliance without requiring a blister card that is altered from the normal form, fit, and function of currently manufactured blister cards. In other words, no alteration of lidding film 204, such as patterning it into traces, adding terminals and/or traces that overlay it, or other such alteration from the standard full-surface lidding film is required in order for its state to be determined by packages in accordance with the present disclosure.

Figure 6:
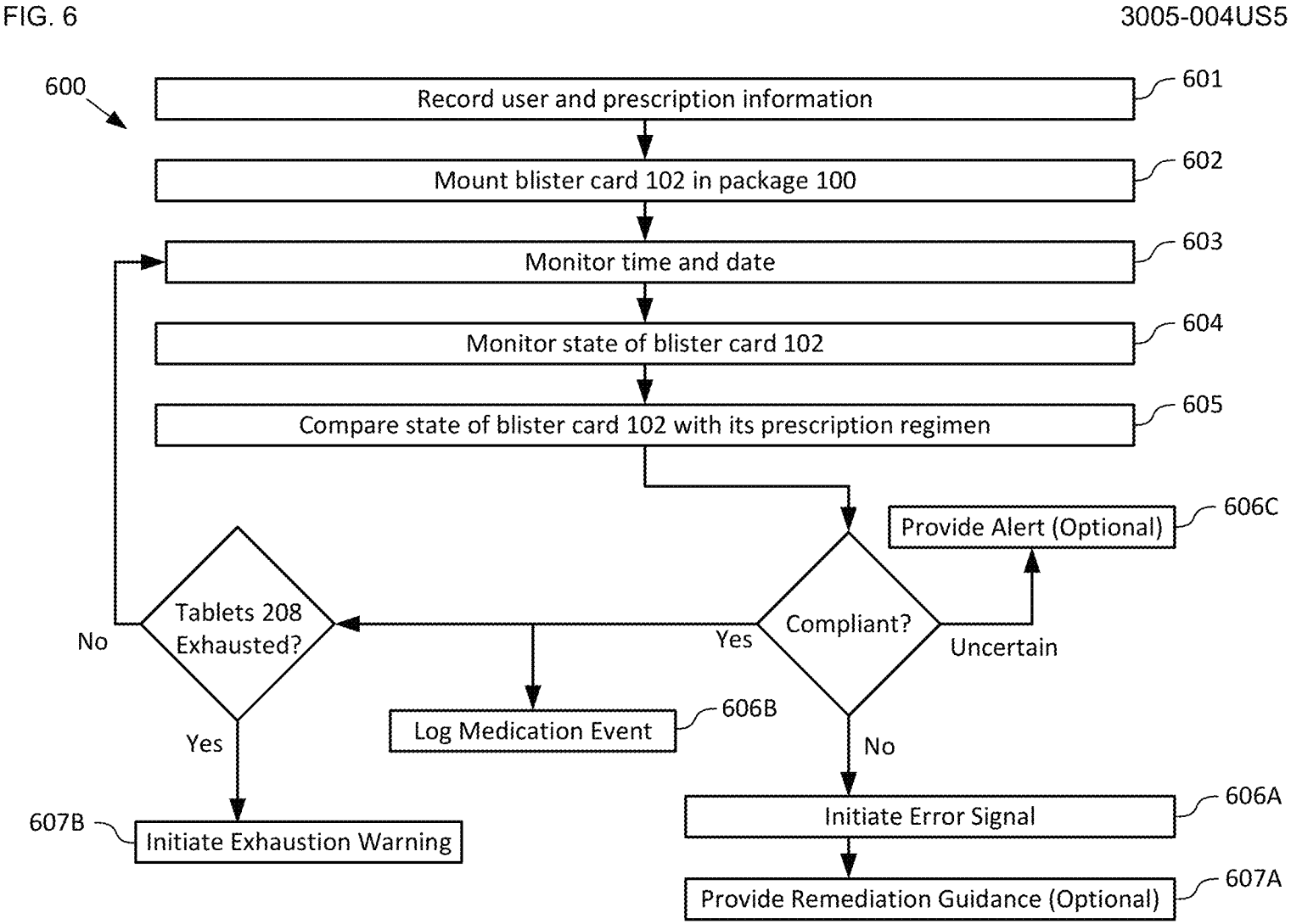
FIG. 6 depicts operations of a method for monitoring adherence to a dosing regimen in accordance with the illustrative embodiment.

FIG. 6 depicts operations of a method for monitoring adherence to a dosing regimen in accordance with the illustrative embodiment. Method 600 begins with operation 601, wherein user data and prescription information for blister card 102 (e.g., identity of tablets 208, etc.) is entered into a mobile app stored on wireless device 114. Method 600 is described with continuing reference to FIGS. 1 through 5A-B.

Typically, user information includes one or more of:

Log-in credentials;

Privacy agreement (Agree or Do Not Agree);

Cycle Length;

First day of last period; and

Daily Reminder settings:

- Reminder type: alarm, text and/or email;
- Customized reminder message (e.g., "Take your Pill");
- Snooze activation; and
- Alarm type (e.g., sound).

Typically, prescription information includes one or more of:

Number of days since the current card was started (typically only when a partially used blister card is to be used); and Time or time window to take a pill.

In some embodiments, package 100 includes an alphanumeric display that presents information directly to the user regarding the prescription provided in blister card 102, such as an identification code, dosing information, time until the next dosing window, etc. In some embodiments, such information is provided wirelessly to mobile device 114 to enable the mobile device to provide such information to the user.

At operation 602, blister card 102 is mounted in package 100 and located by receiver 106.

At operation 603, electronics module 110 monitors the time and date via an onboard clock. In some embodiments, mobile device 114 monitors the time and date. In some embodiments, electronics module 110 requests time and date information from mobile device 114. In some embodiments, the time and date are tracked in another conventional manner.

At operation 604, the state of blister card 102 is monitored by periodically determining the state of monitoring region MR1. In the illustrative embodiment, for example, the state of blister card 102 is determined periodically each day (e.g., every minute, hour, several hours, etc.) throughout the anticipated dosing period of 28 days and compared to a state of the blister card determined previously.

Figure 7:
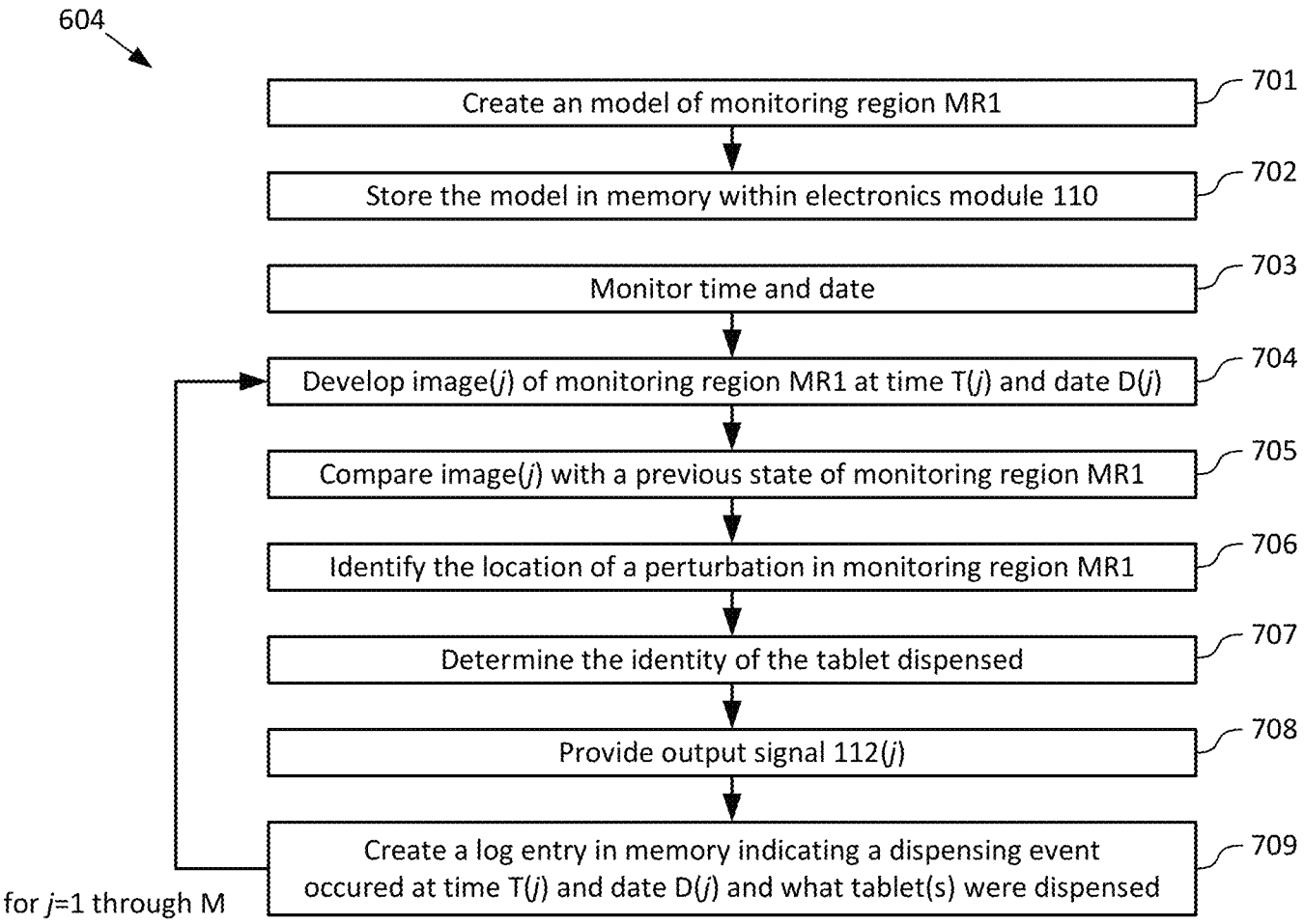
FIG. 7 depicts sub-methods of a sub-operation suitable for monitoring the state of a blister card in accordance with the illustrative embodiment.
Figure 8A:
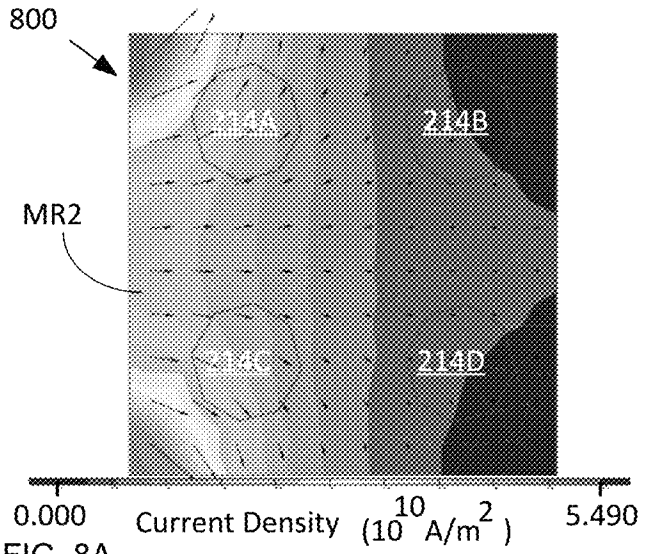
FIGS. 8A-D depict EIT models for different exemplary states of a monitoring region that includes four dispensing regions.
Figure 8B:
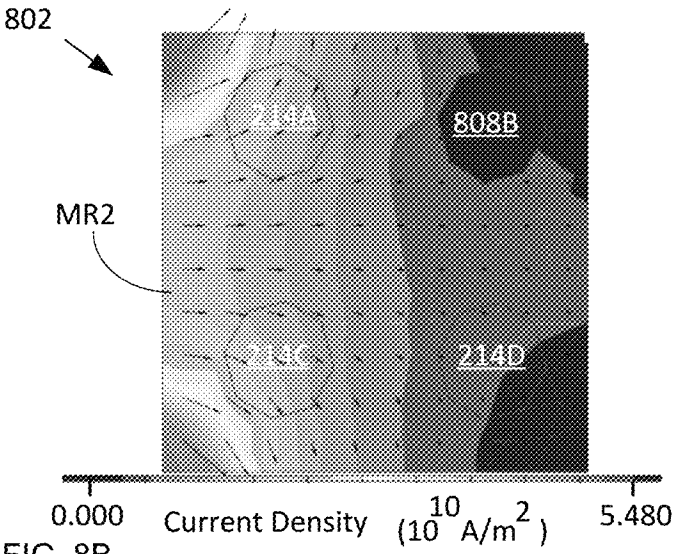
Figure 8C:
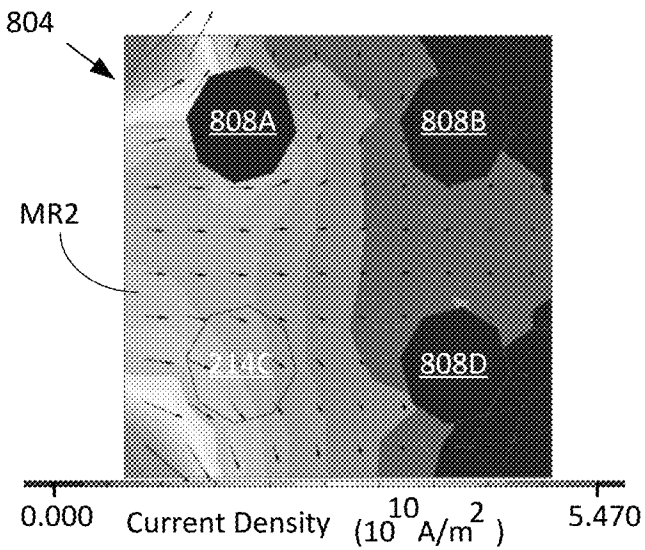
Figure 8D:
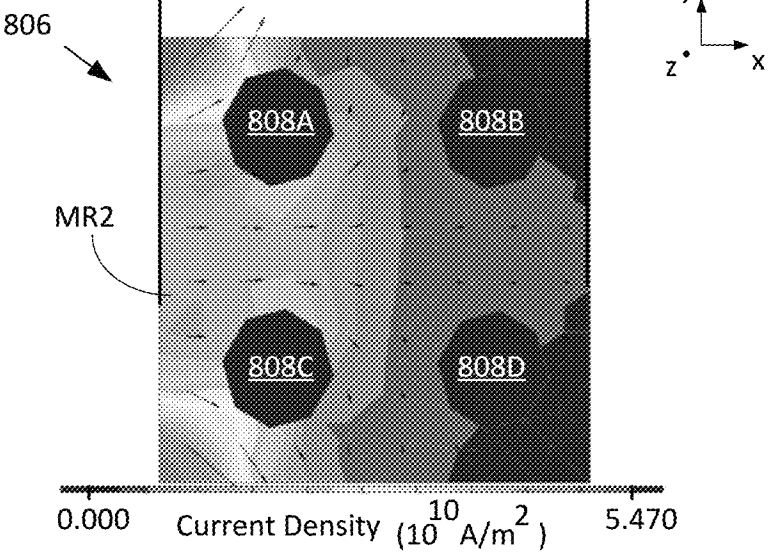

FIG. 7 depicts sub-methods of a sub-operation suitable for monitoring the state of a blister card in accordance with the illustrative embodiment. Operation 604 begins with sub-operation 701, wherein an EIT model of monitoring region MR1 is created. The EIT model comprises a plurality of computed maps of the current density distribution throughout the region based on assumed electrical stimuli. Each map is based on a different anticipated configuration of openings in lidding film 104. Generating this plurality of computed maps is often referred to as "solving the forward problem."

FIGS. 8A-D depict EIT models for different exemplary states of a monitoring region that includes four dispensing regions. Each of plots 800-806 is based on a finite-element 2-D electrical model of current density distribution for a four-terminal arrangement around the perimeter of monitoring region MR2, which encompasses four dispensing regions 214. Monitoring region MR2 is analogous to monitoring region MR1.

Plot 800 depicts the current density distribution in monitoring region MR2 while the lidding film is in its original state (i.e., without any broken dispensing regions).

Plot 802 depicts the current density distribution in monitoring region MR2 after formation of opening 808B at dispensing region 214B.

Plot 804 depicts the current density distribution in monitoring region MR2 after the additional formation of openings 808A and 808D at dispensing regions 214A and 214D.

Plot 806 depicts the current density distribution in monitoring region MR2 after the additional formation of opening 808C at dispensing region 214C.

It can be readily seen from plots 800-806 that the conductivity of each tablet-area changes each time a dispensing region 214 is broken. This change in the conductivity results in a significant change in the current density distribution of the lidding film within monitoring region MR2 and the corresponding output voltages measured at the terminals arranged around its perimeter.

At sub-operation 702, the EIT model of monitoring region MR1 is stored as a look-up table in a memory cell within electronics module 110.

At sub-operation 703, electronics module 110 registers the date and time at which lid 302 is closed.

For j=1 through M, where M is equal to the number of tablets included in blister pack 102:

At sub-operation 704, ERT imaging is used to generate an impedance map of monitoring region MR1 at time T(j) and date D(j). ERT imaging employs pair-wise measurements of an electrical parameter between all possible pair-combinations of terminals 506. Specifically, in the depicted example, an electric current is sequentially generated between each terminal-pair combination of terminals 506 and the voltage potential at each other terminal of terminals 506 is measured to determine the potential difference between their respective locations for that current flow. These voltage measurements are then used to generate the map of the impedance distribution within monitoring region MR1 (i.e., to generate image(j) of the monitoring region).

Sub-operation 704 is analogous to ERT imaging methods described by LaBrecque in U.S. Pat. No. 8,733,432 and EIT imaging methods described by Duraiswami, et al., in "Efficient 2D and 3D EIT using dual reciprocity boundary element techniques," each of which is incorporated herein by reference.

For example, LaBrecque discloses, " . . . in ERT, each measurement uses four electrodes; one pair of electrodes serves as the current source and sink and a second pair measures the potential difference between two points. For a system with N electrodes there are approximately $N^4$ different configurations referred to as arrays." In similar fashion, Duraiswami discloses, "In electrical impedance tomography (EIT) the distribution of impedances inside an object ('image') is sought by applying specified currents at some electrodes, and performing measurements of the voltage at other electrodes. The equations for the electric field then provide a relationship between the impedance distribution inside the medium and the measured voltages and applied currents. Different kinds of materials have different impedances, and the availability of an impedance map provides an image of the material distribution." One skilled in the art will recognize that ERT and EIT measurements, such as those described by LeBrecque and Duraiswami, are suitable for use in embodiments of the present invention.

At sub-operation 705, image(j) is compared with a previous image of the monitoring region (typically, the most recently acquired image, image(j−1)) and/or the EIT model generated in sub-operation 701.

At sub-operation 706, the location of a perturbation (e.g., a new hole) in the state of monitoring region MR1 is identified based on the comparison performed in sub-operation 705.

At sub-operation 707, the identity of the tablet that was dispensed is identified based on the location of the perturbation identified in sub-operation 706 and comparing it to known locations of dispensing regions 214.

At sub-operation 708, output signal 112(*j*) is provided to mobile device, where the output signal includes the identity of the tablet that was dispensed, as well as date D(j) and time T(j).

At sub-operation 709, a log entry is stored in memory included in electronics module 110, where the log entry includes the state of blister card 102, the identity of the tablet that was dispensed, as well as date D(j) and time T(j).

Returning now to method 600, at operation 605, the state of blister card 102 is compared with the recommended dosing regimen for the prescription it contains (i.e., tablets 208). In the illustrative embodiment, this comparison occurs periodically each day (e.g., every minute, hour, several hours, etc.) throughout the anticipated dosing period of 28 days. In some embodiments, it occurs at each closure of lid 302. In the depicted example, the prescribed dosing regimen is maintained in the mobile app running on mobile device 114, which provides dosing-regimen data to electronics module 110 via input signal 116. In some embodiments, the dosing regimen is downloaded into a memory module included in electronics module 110. In some embodiments, output signal 112 provides blister-card-state information to mobile device 114, which compares it to the dosing regimen.

In some embodiments, the state of the blister card (e.g., number of tablets dispensed, which tablet or tablets have been dispensed, etc.) is saved by electronics module 110 upon closure of lid 302. Upon the next opening of the lid, the status of the blister card is again examined and compared to the last saved state. This ensures that untimely change of a blister card is detected and the user is asked related questions through the mobile app. Further, the blister-pack state upon opening provides a baseline against which a state change can be measured. In some embodiments, detection of an unanticipated difference between the blister-pack states at lid closing and opening gives rise to error signal 118, which is transmitted to the user and/or a third party to alert one or both of the possibility of an error.

If operation 605 reveals an improper dispensing event, method 600 continues with operation 606A, wherein error signal 118 is initiated by electronics module 110. In the depicted example, error signal 118 is a message transmitted to the user via wireless device 114. In some embodiments, error signal 118 is a visual and/or audible alert generated by package 100 via a conventional interface (e.g., an LED, speaker, buzzer, alphanumeric display, and the like).

Improper events that would initiate error signal 118 being sent to the user or user's care circle include, without limitation:

i. the dosing-time window has passed and the anticipated tablet 208 has not been dispensed; or
ii. an incorrect tablet 208 has been dispensed during the dosing-time window; or
iii. a tablet 208 has been dispensed at a time other than its proper dosing-time window; or
iv. more than one tablet 208 has been dispensed when only one tablet should have been dispensed; or
v. any combination of i, ii, iii, and iv.

In some embodiments, error signal 118 is initiated by one or more anomalies in the environmental conditions to which blister card 102 was subjected, such as exposure to a temperature or humidity extreme, excessive shock, unscheduled access to blister card 102, which might indicate unauthorized access such as tampering, ingestion by a child, etc.

At optional operation 607A, dosing-regimen non-compliance remediation guidance is provided to the user via wireless device 114 and/or a touch display incorporated into housing 104, where the guidance is based on the user's deviation from the dosing regimen from the medication contained in blister card 102. In some embodiments, at operation 607A, the user is provided with additional counseling and education information. Since the point of the cycle for the user is known, in some embodiments, the user is provided contextual health and wellness information to the user. The ability to provide a user with recommended steps for remediation for dosing-regimen non-compliance arises from the ability of packages in accordance with the present disclosure to compare actual dosing-regimen compliance information acquired by package 100 to the OCP dosing-regimen for blister card 102. This capability is particularly advantageous when adherence to the dosing regimen is interrupted, such as when a tablet is missed and the user is unsure of recommended steps for best mitigating the risk of an unintended pregnancy.

In some embodiments, an alphanumeric display is incorporated into housing 110 (typically on the inside of lid 302) to enable direct interaction with the user via a visual interface. This facilitates communication/engagement with the user, such as conveying information, receiving responses to feedback questions, as well as providing error signals, warnings, dosing-regimen-compliance indications, and/or dosing-regimen-non-compliance alerts.

Further, embodiments in accordance with the present disclosure enable dosing-regimen-adherence-status feedback to help the user to adjust her behavior accordingly. Such feedback also can be provided to the user's care circle for needed intervention toward improving dosing-regimen compliance. Still further, in some embodiments, the dosing-regimen-adherence-status feedback can be stored in long-term memory at a monitoring site for use in long-term care treatment planning, to enable its use as evidence in legal proceedings, civil proceedings (e.g., paternity suits, product-liability actions, etc.), and the like.

If operation 605 reveals that the correct tablet 208 has been dispensed within its allotted dosing-time window, method 600 proceeds with operation 606B, wherein identity of the tablet dispensed and the date and time at which the dispensing occurred are logged into memory by electronics module 110, and the electronics module 110 transmits compliance indicator 120. Any of a variety of indicators can be used to denote compliance, including, without limitation, an indicator light or LED on package 100, a textual message presented on an alphanumeric display that can be located on one or both of package 100 and via mobile device 114, etc.).

If the properly dispensed tablet was the last tablet in blister card 102, method 600 continues with operation 607B, wherein an exhaustion warning is issued to the user and/or the user's care circle that blister card 102 is now empty. In some embodiments, this warning is generated when the number of tablets in the blister card 102 has dropped to a threshold level greater than zero to initiate a refill reminder to the user and/or user's care circle, or automatically generate a refill request directly to the pharmacy before the supply of tablets in the blister card is exhausted. In some embodiments, the exhaustion warning is issued as part of error signal 118.

If blister card 102 is not depleted, method 600 continues with the repetition of operations 603 through 607.

In some cases, current dosing-regimen compliance is determined at operation 605; however, a risk of future non-compliance is detected based on, for example, the geolocations of blister card 102 and the user. In some cases, the geolocation of the user is based on the location of mobile device 114, which can be monitored during operation 605 using any of a variety of known techniques (e.g., Bluetooth radio-signal ranging, geolocation detection of package 100 and mobile device 114, etc.).

A risk of future non-compliance might be detected if, for example, the blister card and the mobile device are not within the same general space (e.g., within the confines of the user's home, office, etc.). When this distance exceeds a threshold, such as when the user has left her home without package 100 while a dosage time is approaching in the near future, a risk of non-compliance is identified. In response to this identified risk, method 600 continues with operation 606C, in which an alert containing a reminder is sent to the user. The stridency of the reminder can be weighted in importance depending on how soon the next dose is due and/or how far the user is from the package.

In some embodiments, during operation 605, the identification of the risk of future non-compliance includes accessing a calendar on which future events for the user are stored. Such calendars are commonly stored on mobile devices and through the "cloud". Events stored on such a calendar include, without limitation, daily events (e.g., times and locations of business meetings and/or social events held away from home or the office, etc.), travel events (e.g., overnight stays away from home, multi-day vacation trips to different locations, etc.), and the like. If a risk of future non-compliance is identified, method 600 continues with operation 606C, wherein electronic module 110 issues an alert to the user to notify her that there is a risk that package 100 will be left behind. Examples of situations that could result in a risk of future non-compliance include, without limitation, a future event having an event duration that overlaps with a dosing window of the dosing regimen, a future event being associated with a geolocation separated from the geolocation of package 100 by a distance that might not allow sufficient travel time for the user to access blister card 102 within an upcoming dosing window, etc. In some embodiments, the alert issued in operation 606C includes a reminder to encourage the user to take steps to mitigate the risk of deviating from the dosing regimen for the medication in blister card 102, such as, advising that the proper tablet be taken before leaving, advising the user to pack package 100 (and spare blister cards, if necessary) in preparation for the upcoming trip, and the like.

Furthermore, in some embodiments, additional features are incorporated to help the user better manage her health. For example, at operation 606B, the user may be provided a reward through the mobile and/or an opportunity to input notes into the mobile app, e.g., recording experiencing side effects, having intercourse in the last 24 hours, etc.

One skilled in the art will recognize, after reading this Specification, that method 600 is merely one non-limiting, exemplary method for improving compliance with a dosing regimen and that myriad alternative methods can be employed without departing from the scope of the present invention.

As noted above, although ERT/EIT-based tomographic imaging are well suited for determining the state of blister card 102, myriad alternative sensing technologies can be exploited for determining the state of lidding film 204 without departing from the scope of the present disclosure.

Alternative Sensing Approaches for Monitoring the State of a Blister Card

Figure 9A:
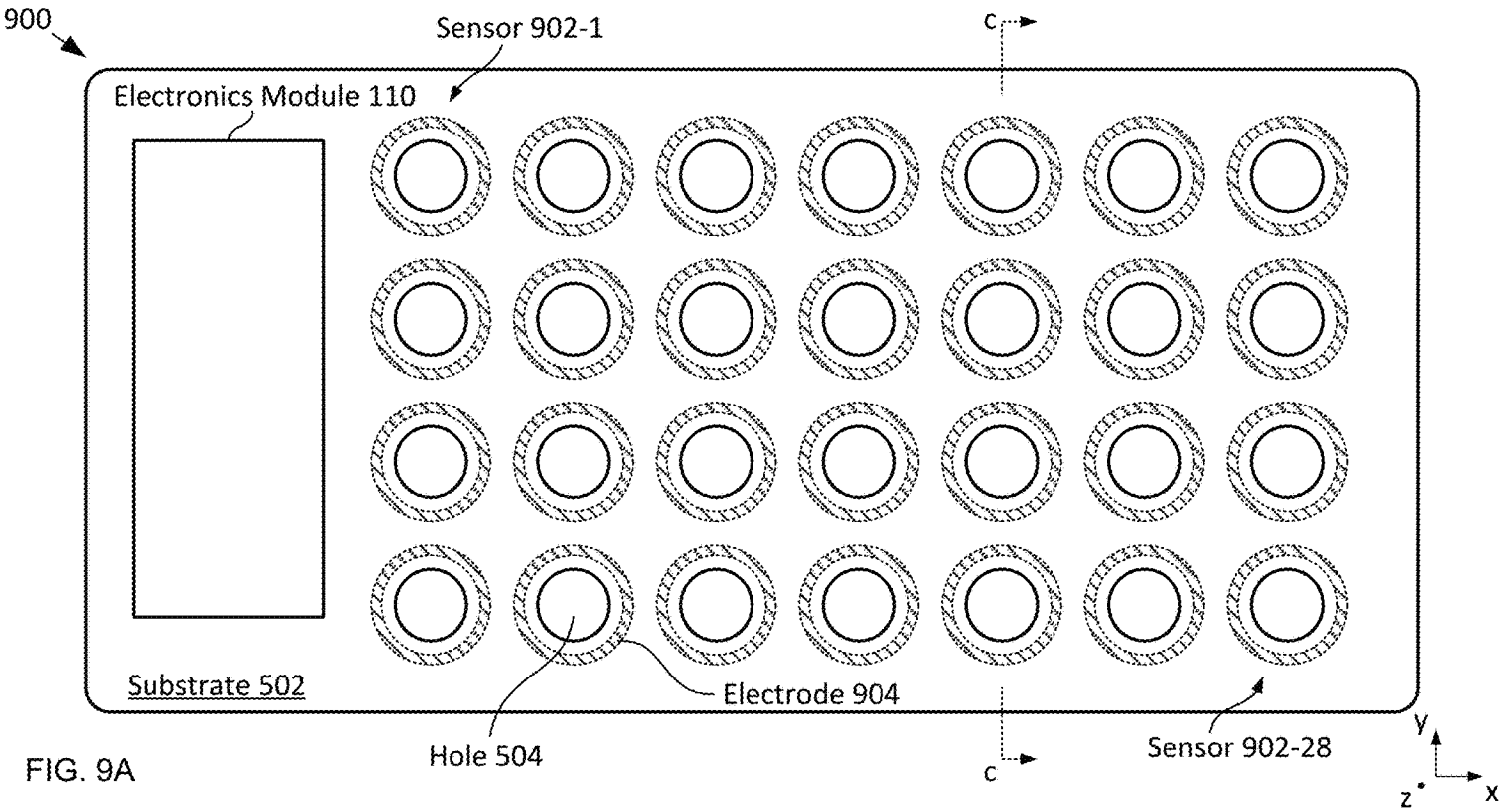
FIGS. 9A-B depict schematic drawings of top and cross-sectional views, respectively, of a capacitive-sensing-based detection module in accordance with an alternative embodiment of the present invention.
Figure 9B:
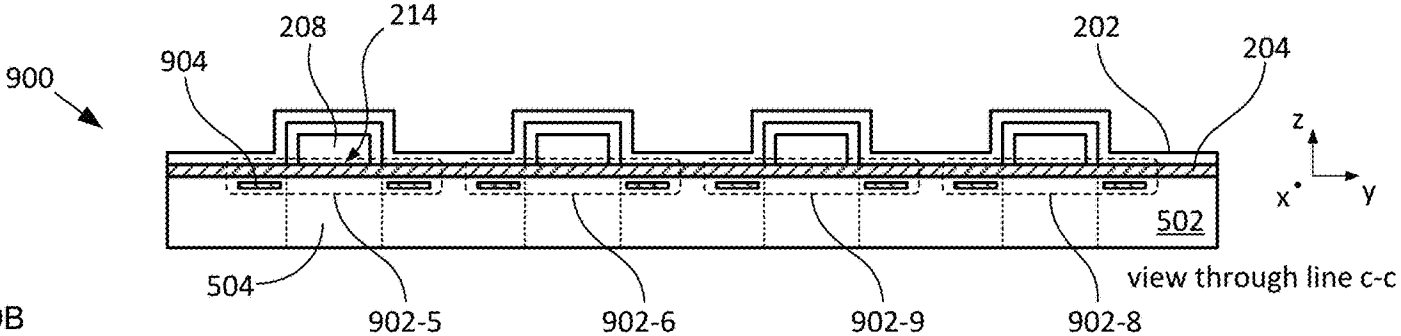

FIGS. 9A-B depict schematic drawings of top and cross-sectional views, respectively, of a capacitive-sensing-based detection module in accordance with an alternative embodiment of the present invention. Detection module 900 comprises substrate 502, holes 504, and sensors 902-1 through 902-28 (referred to, collectively, as sensors 902).

Each of sensors 902 includes an electrode 904 and its respective dispensing region 214 of lidding film 204. Electrode 904 is a planar, circular metal electrode that completely surrounds hole 504. Electrode 904 is formed within the body of substrate 502 such that, when blister card 102 is in contact with detection module 108, the electrode and lidding film 204 form a capacitive sensor 902, whose capacitance is based on the state of the lidding film in its respective dispensing region 214, as depicted in FIG. 9B. In some embodiments, sensors 902 (as well as other sensors described herein) are formed directly on a surface of the bottom of housing 104, thereby obviating substrate 502.

Each of sensors 902 is electrically connected to sensing circuitry in electronics module 110 via electrical traces (not shown for clarity). As a result, each sensor can be monitored individually to enable specificity of the dispensing of each tablet 208 of blister card 102. In some embodiments, sensors 902 are electrically connected and interrogated using a row/column addressing scheme.

OCP represents one of many applications wherein it is critical to be able to identify when a particular tablet has been dispensed during a dispensing event. One skilled in the art will recognize, however, after reading this Specification, that not all medication requires the ability to uniquely identify the tablet that has been dispensed and, as a result, the sensing approach used to detect dispensing of a tablet can be greatly simplified. For example, in some cases, all of the tablets of a blister card are substantially identical. In some embodiments of the present invention, therefore, all of sensors 902 are electrically connected in parallel or serially and specificity for which tablet 208 is dispensed is not enabled. In some such embodiments, a single sensor is used to detect dispensing events, such as an accelerometer operatively coupled with the blister card, a single capacitive sensor that spans all the tablet sites such that each dispensing event is indicated by a change in the capacitance of this solitary capacitor.

Alternatively, in some embodiments, row/column sensing is simplified to row or column sensing wherein, for example, one electrode of a capacitive sensor is common to an entire row or column of tablet locations, while the other electrode is divided into site-specific individual electrodes.

In such embodiments, exhaustion of a blister card (which denotes a refill is due) can be detected in numerous ways, such as simply tracking the dispensing events and comparing their count to the total count of the tablets on the blister card as provided or monitoring of the total magnitude of the sensor output signal change with dispensing events and comparing the result with a reference magnitude change determined, for example, by prior calibration operation.

In each sensor 902, the conductive material (i.e., lidding film 204) of its dispensing region 214 forms fringing fields with its electrode 904. These fringing fields impact the capacitance of the capacitive sensor giving it a first value when the dispensing region is intact. When tablet 208 is dispensed, however, the breakage of dispensing region 214 changes the physical configuration between the lidding film material and electrode 904, which affects the fringing fields and, therefore, the capacitance of sensor 902. It should be noted that the capacitance of sensor 902 changes whether or not the material of dispensing region 214 breaks away entirely or pieces of it remain hanging in hole 504 thereafter.

To sense the capacitance of each sensor 902, lidding film 204 is electrically grounded, while each electrode 904 is connected to a high-impedance sense circuit. In some embodiments, lidding film 204 is left electrically "floating;" however, grounding the lidding film is preferable because it provides improved sense-signal stability and noise immunity. Unfortunately, sensor 902 can be sensitive to external noise and interference, such as stray or parasitic capacitances, electromagnetic interference (EMI), and the like.

In some embodiments, in order to mitigate the effects of noise and interference, electrode 904 is segmented into a pair of half-rings. In some embodiments, electrode 904 is segmented into more than two circumferential sections. Using such electrode configurations, capacitive sensing is implemented by monitoring the change in the capacitance between the electrode segments, which is still affected by fringing fields between the electrode segments and the aluminum foil over the hole. Unfortunately, while segmenting electrode 904 provides some measure of noise immunity, noise and interferences can still be a problem.

Figure 10A:
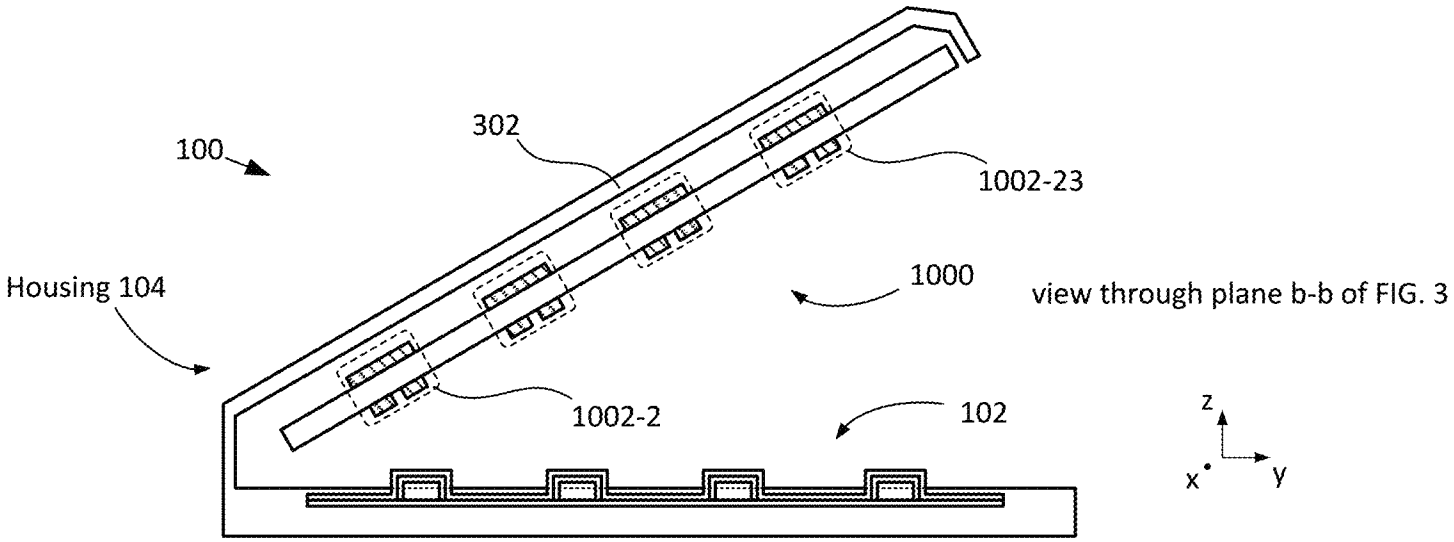
FIG. 10A depicts a schematic drawing of a cross-sectional view of package 100 having an alternative capacitive-sensing-based detection module.

FIG. 10A depicts a schematic drawing of a cross-sectional view of package 100 having an alternative capacitive-sensing-based detection module. Package 100 is depicted in its open state and with blister card 102 located in the package by receiver 106 (not shown for clarity). The package cross-section depicted in FIG. 10A is taken through a plane along line b-b depicted in FIG. 3.

Detection module 1000 includes sensor substrate 502 and sensors 1002-1 through 1002-28 (referred to, collectively, as sensors 1002), which are arranged on the substrate in an arrangement that matches that of tablets 208 on blister card 102.

Detection module 1000 is analogous to detection module 108 described above; however, detection module 1000 is located in lid 302 by a receiver that is analogous to receiver 106 described above (not shown for clarity). The closure of lid 302 brings detection module 1000 into close proximity with blister card 102, thereby operatively coupling each of sensors 1002 with its respective tablet 208.

Figure 10C:
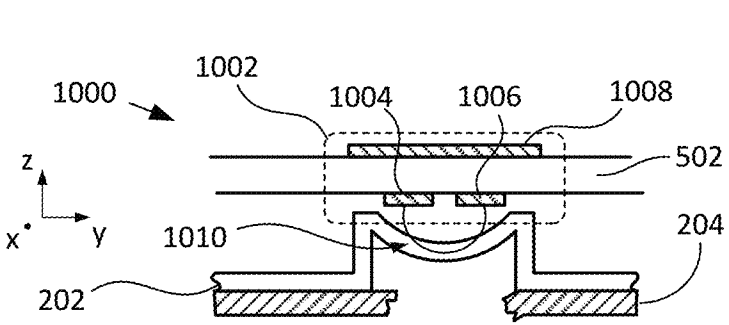
FIGS. 10B-C depict cross-sectional views a portion of detection module 1000 before and after dispensing of a tablet, respectively, in accordance with the present invention.
Figure 10B:
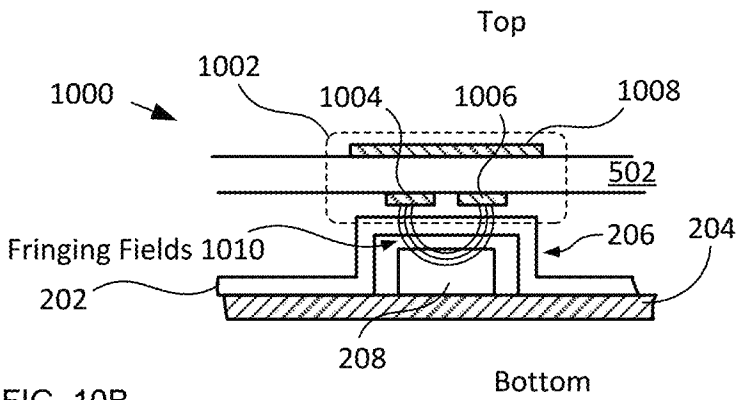

FIGS. 10B-C depict cross-sectional views a portion of detection module 1000 before and after dispensing of a tablet, respectively, in accordance with the present invention.

Each of sensors 1002 includes electrodes 1004 and 1006 and electric shield 1008.

Electrodes 1004 and 1006 are electrically conductive electrodes disposed on a first surface of substrate 502.

Electric shield 1008 is an electrically conductive electrode disposed on a second surface of substrate 502. Shield 1008 is grounded such that it is operative for shielding electrodes 1004 and 1006 from electrical noise and interference emanating from the top side of detection module 1000. Lidding film 204 is also typically grounded, thereby enabling it to act as a shield from the bottom side for electrodes 1004 and 1006.

When lid 302 is closed and tablet 208 is located in reservoir 206, electrodes 1004 and 1006 are capacitively coupled with tablet 208 via fringing fields 1010. As a result, the capacitance between electrodes 1004 and 1006 is based on these fringing fields.

When lid 302 is closed and reservoir 206 is empty of its tablet, however, fringing fields 1010 are coupled with only the remnants of reservoir 206 (i.e., deformed forming film 202), which gives rise to a difference in the capacitance between electrodes 1004 and 1006 from that of a filled reservoir because of the different manner in which fringing fields 1010 couple with the empty reservoir.

In operation, typically, detection module 1000 interrogates blister card 102 each time lid 302 is closed. The output signal from the detection module is then compared to the most recent previous blister-pack state to determine whether a tablet has been dispensed and, if so, which tablet. In some embodiments, the presence or absence of a tablet 208 in each reservoir 206 is determined by a change in the absolute magnitude of sense capacitances between lid closures, using a previously calibrated threshold value to indicate presence or absence of a tablet in each reservoir 206.

Figure 10E:
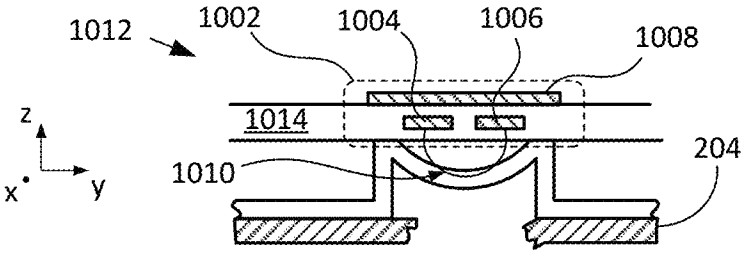
FIGS. 10D-E depict cross-sectional views of a portion of yet another alternative capacitive-sensing-based detection module, before and after dispensing of a tablet, respectively, in accordance with the present invention.
Figure 10D:
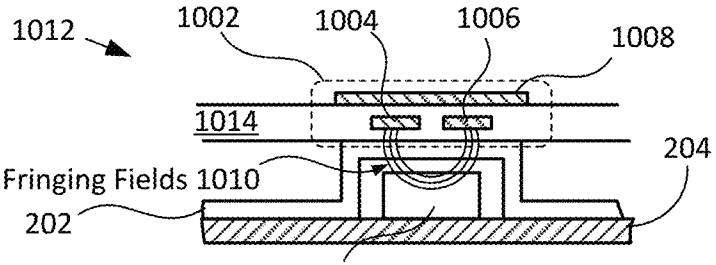

FIGS. 10D-E depict cross-sectional views of a portion of yet another alternative capacitive-sensing-based detection module, before and after dispensing of a tablet, respectively, in accordance with the present invention. Detection module 1012 is analogous to detection module 1000 described above; however, detection module 1012 is a flexible detection module that is dimensioned and arranged to be placed in contact with blister card 102 during operation.

Detection module 1012 includes substrate 1014 and the plurality of capacitive sensors 1002, as described above.

Substrate 1014 is a flexible substrate comprising polyimide. In some embodiments, substrate 1014 is formed of another material suitable for flexible electronics, such as a polymer, such as poly(methylacrylate) (PMMA), polyimide, polyurethane, polyester, polyether ether ketone (PEEK), and the like. Preferably, substrate 1014 is sufficiently flexible to enable a force applied to it to deform forming film 202 and push tablet 208 through lidding film 204.

When detection module 1012 is in contact with blister card 102, electrodes 1004 and 1006 are capacitively coupled with tablet 208 via fringing fields 1010. As discussed above, the capacitance between electrodes 1004 and 1006 is based on fringing fields 1010 such that the capacitance of each sensor 1002 is based on the presence of its respective tablet 208.

The use of a flexible substrate also enables integration of detection module 1012 in or on forming film 202.

In some embodiments of the present invention, detection module 1012 is formed such that it includes an interior volume for receiving blister card 102 (i.e., detection module has the form analogous to a flexible pouch). The interior volume is dimensioned and arranged such that, when blister card 102 is located in the pouch, the pouch holds the blister card in intimate contact on the top (forming-film side) and bottom surfaces (lidding-film side). The top and bottom surfaces of the pouch incorporate holes to enable access to reservoirs 206 and dispensing regions 214. Alternatively, as described in some embodiments above, the detection module may include a substrate that is sufficiently flexible to partially or fully cover the topside holes. It should be noted that such embodiments of the present invention can be implemented using more than one of the different sensing approaches described herein. These embodiments are particularly well suited for use with capacitive sensing and tactile sensing techniques.

Acoustic Sensing

Figure 11B:
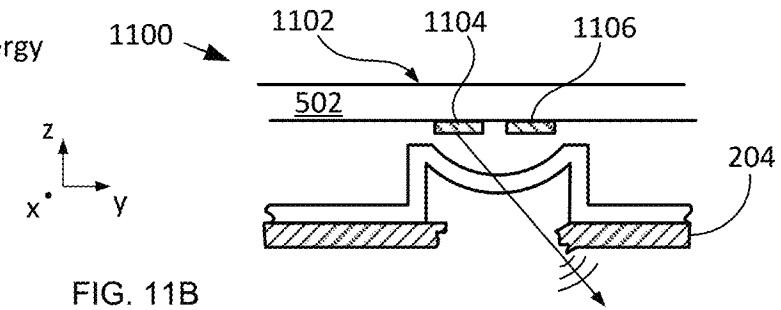
FIGS. 11A-B depict cross-sectional views of a portion an alternative acoustic-sensing-based detection module, before and after dispensing of a tablet, respectively, in accordance with the present invention.
Figure 11A:
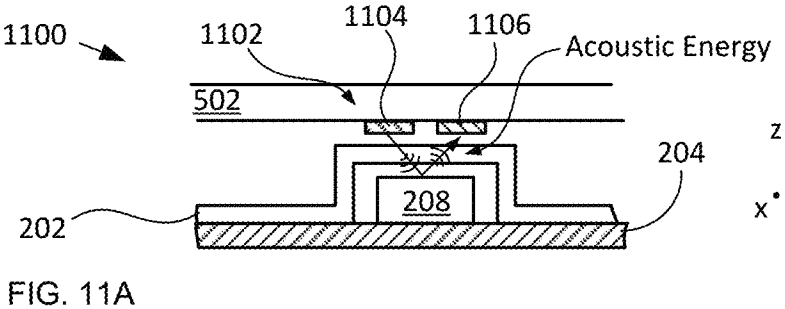

FIGS. 11A-B depict cross-sectional views of a portion an alternative acoustic-sensing-based detection module, before and after dispensing of a tablet, respectively, in accordance with the present invention. Detection module 1100 is analogous to detection module 108 described above; however, detection module 1100 includes substrate 502 and a plurality of acoustic sensors 1102, each of which is operative for detecting the presence of a tablet in a blister-card reservoir when the detection module is operatively coupled with a blister card from its forming-film side.

Each of acoustic sensors 1102 comprises transmitter 1104 and acoustic detector 1106.

Transmitter 1104 is a piezoelectric transducer operative as a conventional acoustic transmitter. Transmitter 1104 is arranged to direct acoustic energy (e.g., ultrasonic waves, etc.) toward tablet 208 when detection module 1100 is aligned with blister card 102.

Acoustic detector 1106 is a piezoelectric transducer operative as a conventional acoustic receiver. Acoustic detector 1106 is arranged to receive acoustic energy from the direction of tablet 208 when detection module 1100 is aligned with blister card 102.

In the depicted example, detection module 1100 is mounted on the inside surface of lid 302 of housing 104. Sensors 1102 are arranged on substrate 502 such that, when lid 302 is closed, the sensors are brought into contact with reservoirs 206 of blister card 102 to operatively couple each sensor with a different reservoir. In some embodiments, sensors 1102 and reservoirs 206 are separated by a small air gap when lid 302 is closed. In some embodiments, detection module 1100 is located within housing 104 via a receiver, as discussed above.

One skilled in the art will recognize, after reading this Specification, that the acoustic impedance of reservoir 206 is different when it is occupied with a tablet 208 versus when the reservoir is empty. In operation, each time lid 302 is closed, each of sensors 1102 provides an electrical signal whose magnitude is indicative of whether its respective reservoir contains a tablet. When a change in the acoustic impedance from the previous interrogation of blister card 102 is sensed, electronics module 110 can determine that a tablet-dispensing event has occurred, as well as identify which tablet has been dispensed. In some embodiments, the presence or absence of a tablet 208 in each reservoir 206 determined based on the absolute magnitude of acoustic signatures, using previously calibrated threshold values to indicate presence or absence of a tablet in each reservoir 206.

In some embodiments, detection module 1100 comprises a flexible substrate that is analogous to substrate 1312 described above. In such embodiments, sensors 1102 are formed in such substrate using flexible piezoelectric films (e.g., polyvinylidene fluoride or polyvinylidene difluoride, also known as PVDF, etc.) in accordance with conventional flexible-electronics fabrication technology. As discussed above, the use of a flexible substrate in detection module 1100 enables a force applied to the detection module to deform forming film 202 and push tablet 208 through lidding film 204. It also enables integration of detection module 1100 in or on forming film 202. Further, in some embodiments, a flexible substrate enables the use of the piezoelectric materials of sensors 1102 to harvest mechanical energy (e.g., such as that generated while a tablet is being dispensed) and convert it into electrical energy usable for powering detection module 1100.

One skilled in the art will recognize that detection module 1100 can be dimensioned and arranged for operation from the lidding film side of blister card 102 without departing from the scope of the present invention.

In some embodiments, transmitter-free acoustic sensing is achieved by disposing three or more microphones on blister card 102.

Figure 12:
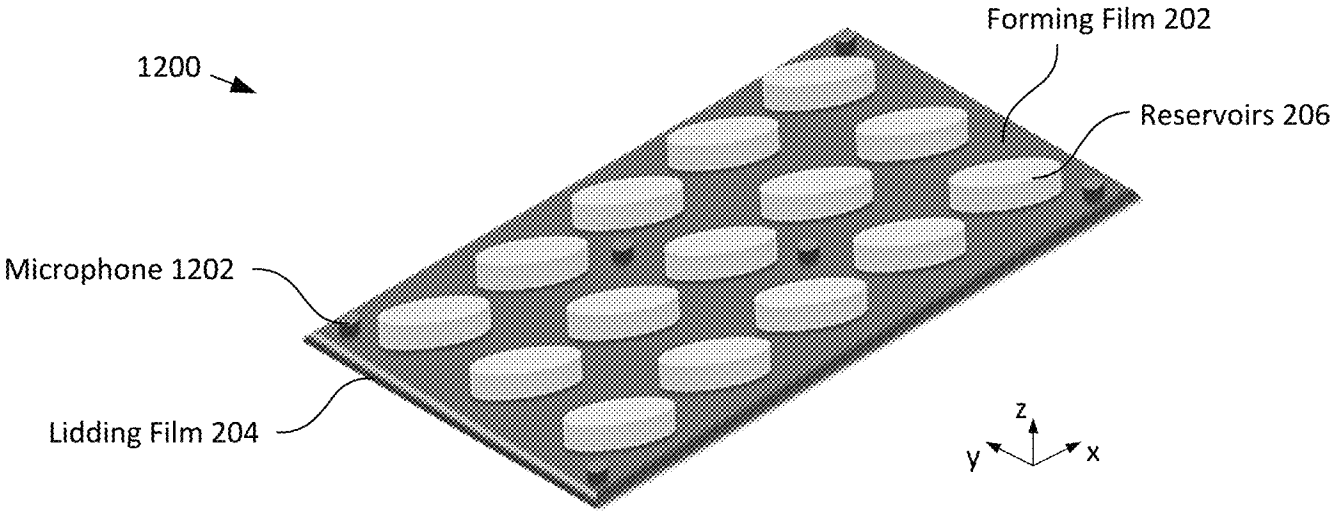
FIG. 12 depicts a schematic drawing of a perspective view of a blister card comprising a plurality of microphones in accordance with another acoustic-sensing-based embodiment of the present invention.

FIG. 12 depicts a schematic drawing of a perspective view of a blister card comprising a plurality of microphones in accordance with another acoustic-sensing-based embodiment of the present invention. Blister card 1200 is analogous to blister card 102; however, bister card 1200 includes six microphones 1202, which are disposed on forming film 202 and distributed across its area.

In operation, each microphone detects the sound of a tablet being dispensed. Signal processing capability included in electronics module 110 and/or mobile device 114 processes the outputs of the microphones to triangulate the sound and identify the specific tablet location at which it originates.

In some embodiments, detection module 1200 comprises a flexible substrate, which is placed in contact with blister card 102 within housing 104.

In some embodiments, detection module 1200 comprises a conventional PCB substrate that is mounted on the inside surface of lid 302 of housing 104.

In some embodiments, microphones 1202 are disposed on a PCB substrate having holes that enable force to be applied to reservoirs 206. For example, the PCB substrate would be in the shape of a frame, running along one or more of the inside sidewalls of the housing 104 adjacent to the blister card 102. In some embodiments, detection module 1200 is mounted therein. In some embodiments, detection module 1200 is located therein via a receiver.

Tactile Sensing

Figure 13B:
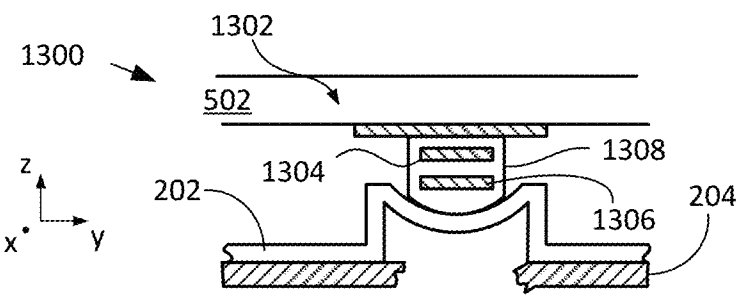
FIGS. 13A-B depict cross-sectional views of a portion of a tactile-sensing-based detection module, before and after dispensing of a tablet, respectively, in accordance with the present invention.
Figure 13A:
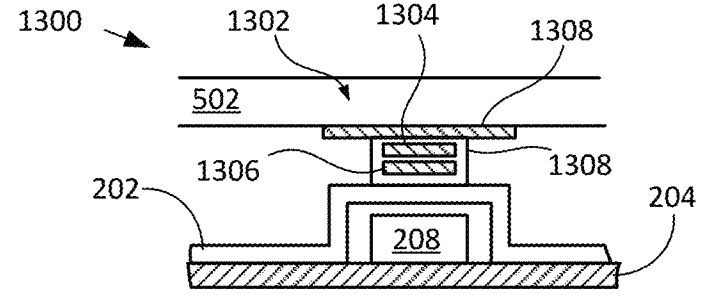

FIGS. 13A-B depict cross-sectional views of a portion of a tactile-sensing-based detection module, before and after dispensing of a tablet, respectively, in accordance with the present invention. Detection module 1300 is analogous to detection module 108 described above; however, detection module 1300 includes substrate 502 and a plurality of tactile sensors 1302, each of which is operative for detecting the presence of a tablet in a blister-card reservoir when detection module 1300 is operatively coupled with blister card 102 from its forming-film side. Sensors 1302 are disposed on substrate 502 in an arrangement that substantially matches the arrangement of tablets in blister card 102.

In the depicted example, detection module 1300 is mounted on the inside surface of the lid 302 of housing 104. In some embodiments, detection module 1300 is located within housing 104 via a receiver, as discussed above.

In the depicted example, each of tactile sensors 1302 includes electrodes 1304 and 1306 and optional shield 1308.

Each of tactile sensors 1302 is a parallel plate capacitor comprising conventional planar electrodes 1304 and 1306 and projection 1308, which is a projection of soft dielectric material (e.g., PMMA, etc.) disposed between and around electrodes 1304 and 1306. The capacitance of sensor 1302 is based on the spacing between its electrodes.

In operation, when lid 302 is closed, sensors 1302 are put into contact with reservoirs 206. When a tablet is contained in a reservoir, a pressure/force is generated between sensor 1302 and the reservoir, which is sufficient to depress the forming film 202 of the reservoir 206 but not large enough to break the lidding film 204 in the dispensing region 214. This force causes compression of the material between electrodes 1304 and 1306, giving rise to a relatively large capacitance for sensor 1302. When a sensor is place in contact with a reservoir that does not contain a tablet, however, little, if any, force is generated between the sensor and the reservoir. As a result, the amount of compression of the material between electrodes 1304 and 1306 is minimal, giving rise to a relatively lower capacitance for the sensor.

At each closure of lid 302, therefore, electronics module 110 reads the capacitance of each sensor 1302 and determines which tablets have been dispensed from blister card 102.

In some embodiments, the region between electrodes 1304 and 1306 is occupied by a piezoelectric material, which provides an electrical output based on the force applied to tactile sensor 1302. Such embodiments allow for harvesting energy from the piezoelectric material to detect the state of the blister card 102 and power the detection module 1300.

In some embodiments, substrate 502 is replaced with a flexible substrate, such as substrate 1014. Typically, sensors 1302 are formed in such a substrate using flexible electronics fabrication technology. In such embodiments, detection module 1300 is sufficiently flexible to enable a force applied to it to deform forming film 202 to push tablet 208 through lidding film 204. Such embodiments enable integration of detection module 1300 in or on the forming film of the blister card.

In some embodiments, the detection module 1300 is operatively coupled with the blister card from its lidding-film side. Sensors 1302 are arranged between dispensing regions 214, such that they are operative for sensing forces imparted to bister card 104 during each dispensing operation.

It would be obvious to one skilled in the art, after reading this Specification, that there are a variety of ways to implement tactile sensing. For example, sensors 1302 can be realized based on any principle that generates a detectable signal, electrical or other, as a result of a tactile stimulus. A broader interpretation of tactile sensing would for example include measurement of deformations of the blister card 102 or surfaces of the housing 104 by utilizing strain sensors on/in flexible substrates directly printed on such surfaces.

Optical Sensing

Figure 14B:
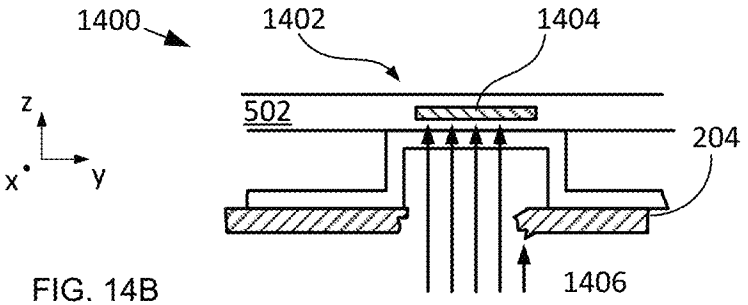
FIGS. 14A-B depict cross-sectional views of a portion of an optical-sensing-based detection module, before and after dispensing of a tablet, respectively, in accordance with the present invention.
Figure 14A:
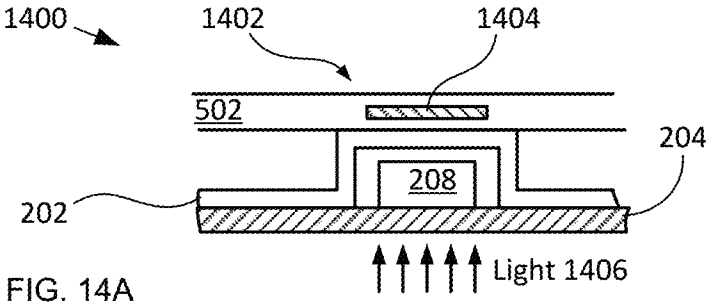

FIGS. 14A-B depict cross-sectional views of a portion of an optical-sensing-based detection module, before and after dispensing of a tablet, respectively, in accordance with the present invention. Detection module 1400 is analogous to detection module 108 described above; however, detection module 1400 includes substrate 502 and a plurality of optical sensors 1402, each of which is operative for detecting the presence of a tablet in a blister-card reservoir when the detection module is operatively coupled with a blister card from its forming-film side. In the depicted example, detection module 1400 is located on the inside surface of lid 302.

Each of sensors 1402 comprises photodetector 1404, which is operative for detecting light 1406. The plurality of photodetectors is disposed on substrate 502 in an arrangement that substantially matches that of tablets 208 of blister card 102.

In the depicted example, light 1406 is ambient light that originates outside housing 104. In some embodiments, light 1406 is provided by a light source included within package 100, typically mounted underneath detection module 108. Light sources in accordance with the present invention include, without limitation, diffuse light sources, arrays of light emitters (e.g., LEDs, lasers, etc.) aligned with photodetectors 1404, etc.

In operation, when a tablet 208 is dispensed, opaque lidding film 204 is fractured, thereby enabling light to pass through detection region 214 of that tablet site to reach photodetector 1404. As a result, detection of light by a photodetector signals that a tablet has been dispensed from its respective sensor location. In some embodiments, the state of blister card 102 is interrogated after each time lid 302 is closed.

Although detection module 1400 is disposed on the top side (i.e., forming-film side) of blister card 102 in the depicted example, it will be clear to one skilled in the art, after reading this Specification, how to make and use alternative embodiments of the present invention wherein detection module 1400 is disposed on the bottom side (i.e., lidding-film side) of blister card 102 such that light signal 1406 passes through the blister card from the top side to the bottom side. In some of these embodiments, the state of blister card 102 is determined at the opening of lid 302. It should be noted that such a configuration is particularly well suited for use with blister cards that contain more than one tablet in at least one reservoir.

In some embodiments, the substrate of detection module 1400 is formed of a transparent, flexible substrate comprising a substantially transparent polymer, such as PMMA, polyimide, polyurethane, polyester, PEEK, and the like. In such embodiments, detection module 1400 can be located in contact with blister card 102. Preferably in such embodiments, the substrate is made of a material suitable for the formation of flexible electronics and is sufficiently flexible to enable a force applied to it to deform forming film 202 to push tablet 208 through lidding film 204. The use of a flexible substrate also enables integration of detection module 1400 in or on forming film 202.

In some embodiments, detection module 1400 includes planar-lightwave circuits (PLCs) whose surface waveguides convey light generated from a source remote to sensors 1402 to each sensor and collect light transmitted through the sensor region and convey it to a remote detector. Preferably, in such embodiments, the PLCs are substantially parallel with blister card 102 and light is coupled from the PLCs into and out of the sensor region via vertical grating couplers.

Figure 15B:
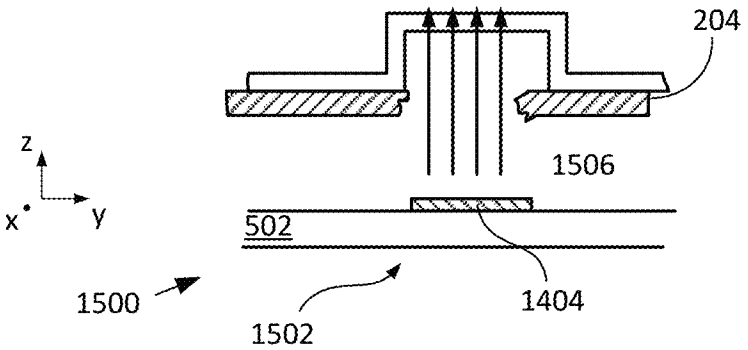
FIGS. 15A-B depict cross-sectional views of a portion of an optical-sensing-based detection module, before and after dispensing of a tablet, respectively, in accordance with the present invention.
Figure 15A:
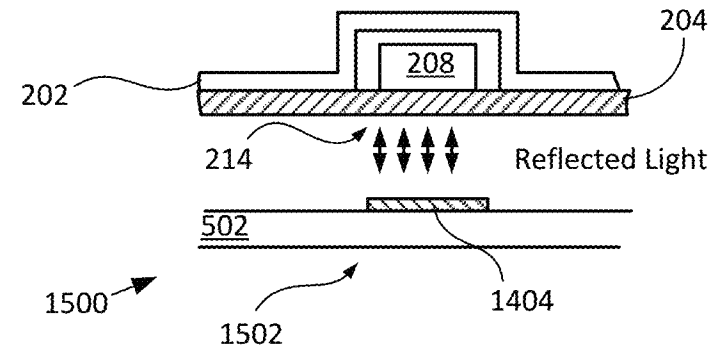

FIGS. 15A-B depict cross-sectional views of a portion of an optical-sensing-based detection module, before and after dispensing of a tablet, respectively, in accordance with the present invention. Detection module 1500 is analogous to detection module 1700 described above; however, detection module 1500 is located on the inside bottom surface of housing 104 and operates in reflection mode. Detection module 1500 includes a plurality of sensors 1502, which is arranged to match the arrangement of tablets in blister card 104.

Each sensor 1502 includes a photodiode 1404, which is dimensioned and arranged to detect light reflected from lidding film 204 only when its respective dispensing region 214 is intact. In the depicted example, sensors 1502 detect ambient light. In some embodiments, each of sensors 1502 also includes a light source for illuminating dispensing region 214. In some embodiments, a single light source is included in detection module 1500 to illuminate the entire lidding film with diffused light.

Thermal Sensing

As mentioned briefly above, thermal sensing can also be used to detect a tablet dispensing event in accordance with the present disclosure. In some embodiments, a first resistor is disposed on lidding film 204 at one end of dispensing region 214. When current flow is driven through the first resistor, it generates heat that conducts into the lidding film. A temperature sensor is disposed on the lidding film 204 on the opposite end of the dispensing region to monitor the local temperature. When the temperature of the heater is increased by an incremental amount, a temperature rise is detected by the temperature sensor when the lidding film is intact in the dispensing region. When the lidding film is broken, however, heat conduction through dispensing region 214 is impeded and the detected temperature rise at the temperature sensor is significantly smaller.

It is to be understood that the disclosure teaches just some examples of embodiments of the present invention and that many variations of the invention can easily be devised by those skilled in the art after reading this disclosure and that the scope of the present invention is to be determined by the following claims.

What is claimed is:

1. A method for monitoring compliance of a user to a dosing regimen for a prescription that includes a plurality of tablets included in a blister card that includes a forming film and a lidding film that is unpatterned, the forming film and a monitoring region of the lidding film collectively defining a plurality of reservoirs for holding the plurality of tablets, wherein each tablet has a corresponding dosing window that starts at a dosing-window start time and ends at a dosing-window end time, the method comprising:

providing a package that includes a detection module and a receiver for locating the blister card such that it is operatively coupled with the detection module;

operatively coupling the detection module and the blister card, the detection module being configured to monitor the state of the monitoring region;

monitoring the state of the monitoring region;

performing a first comparison of a first state of the monitoring region at a first time and an expected state of the monitoring region at the first time, the expected state being based on the dosing regimen; and generating a first output signal based on the first comparison, wherein the first output signal has a first characteristic when the first comparison indicates compliance with the dosing regimen and a second characteristic when the first comparison indicates non-compliance with the dosing regimen.

2. The method of claim 1 further comprising:

determining a first geolocation of the user at a second time;

determining a second geolocation of the detection module at the second time;

determining a risk for future non-noncompliance based on at least the first geolocation, the second geolocation, the second time, and the next dosing window of the sequence thereof; and generating an alert if the risk exceeds a threshold.

3. The method of claim 2 further comprising:

comparing the sequence of dosing windows and an event on a calendar, the event having an event-duration that extends from an event-start time to an event-end time; and generating the alert if at least one dosing window overlaps at least a portion of the event-duration.

4. The method of claim 3 further comprising generating the alert based on a distance between the second geolocation and a third geolocation that corresponds to the event.

5. The method of claim 2 wherein the first geolocation is based on a third geolocation of a device that is electronically paired with the package.

6. The method of claim 1 wherein the detection module monitors the monitoring region via a tomographic technique.

7. The method of claim 6 wherein the tomographic technique is selected from the group consisting of electrical resistance tomography and electrical impedance tomography.

8. The method of claim 1 further comprising providing remediation guidance to the user when the first comparison indicates non-compliance with the dosing regimen.

9. The method of claim 1 further comprising:

performing a second comparison of the first state to a second state of the blister card at a second time that precedes the first time;

identifying the location of a perturbation in the monitoring region based on the second comparison;

identifying a first tablet of the plurality thereof that corresponds to the perturbation; and recording the first time and identity of the first tablet in a data-storage device.

10. The method of claim 1 wherein the first time is a dosing-window end time of a dosing window of the plurality thereof, and wherein the method further comprises:

at each of a plurality of second times, each second time being the dosing-window end time of a different dosing window of the plurality thereof, performing a second comparison of a second state of the monitoring region at the second time with the expected state of the monitoring region at the second time, wherein the plurality of second comparisons includes the first comparison and the plurality of dosing-window end times includes the first time; and for each second time of the plurality thereof, storing the second time and the second state of the monitoring region.

11. The method of claim 1 further comprising generating an exhaustion warning based on the first comparison.

12. The method of claim 1 providing prescription information to the user via at least one of (1) a display located on the package and (2) a device that is electronically paired with the package, wherein the display includes at least one of a visual indicator, an audible indicator, and an alphanumeric display.

13. A method for monitoring compliance of a user to a dosing regimen for a prescription that includes a plurality of tablets included in a blister card that includes a forming film and a lidding film that is unpatterned, the forming film and a monitoring region of the lidding film collectively defining a plurality of reservoirs for holding the plurality of tablets, wherein each tablet has a corresponding dosing window that starts at a dosing-window start time and ends at a dosing-window end time, the method comprising:

for each of a plurality of first times, t(i), where i is equal to 1 through N and N is the number of tablets in the blister card:

(i) determining a first state of the monitoring region by forming image(i) of the lidding film via a tomographic technique selected from the group consisting of electrical resistance tomography and electrical impedance tomography;

(ii) performing a first comparison of the first state at t(i) and an expected state of the monitoring region at t(i), wherein the expected state is based on the dosing regimen; and (iii) generating a first output signal based on the first comparison, wherein the first output signal has a first characteristic when the first comparison indicates compliance with the dosing regimen and a second characteristic when the first comparison indicates non-compliance with the dosing regimen.

14. The method of claim 13 further comprising:

(iv) comparing image(i) and image (i-1), wherein image (0) is a model of the monitoring region when it is perturbation-free;

(v) determining a first location of a first difference between image(i) and image (i-1); and (vi) identifying at least one tablet, tablet(i) of the plurality of tablets that was dispensed between times t(i) and t(i-1) based on the first location.

15. The method of claim 14 further comprising storing each of t(1) through t(N) and tablets(1) through tablet(N) in a data-storage system.

16. The method of claim 13 further comprising:

determining a first geolocation of the user at a second time;

determining a second geolocation of the detection module at the second time;

determining a risk for future non-noncompliance based on at least the first geolocation, the second geolocation, the second time, and the plurality of dosing windows; and generating an alert if the risk exceeds a threshold.

17. The method of claim 16 further comprising:

comparing the sequence of dosing windows and an event on a calendar, the event having an event-duration that extends from an event-start time to an event-end time; and generating the alert if at least one dosing window overlaps at least a portion of the event-duration.

18. The method of claim 17 further comprising generating the alert based on a distance between the second geolocation and a third geolocation that corresponds to the event.

19. The method of claim 16 wherein the first geolocation is based on a third geolocation of a device that is electronically paired with the package.

20. The method of claim 13 further comprising generating an exhaustion warning based on the first comparison.

21. The method of claim 13 providing prescription information to the user via at least one of (1) a display located on the package and (2) a device that is electronically paired with the package, wherein the display includes at least one of a visual indicator, an audible indicator, and an alphanumeric display.

22. A system for monitoring the compliance of a user to a dosing regimen for a prescription that includes a plurality of tablets included in a blister card that includes a forming film and a lidding film that is unpatterned, the forming film and a monitoring region of the lidding film collectively defining a plurality of reservoirs for holding the plurality of tablets, wherein each tablet has a corresponding dosing window that starts at a dosing-window start time and ends at a dosing-window end time, the system comprising:

a detection module that is configured to monitor the state of the monitoring region when the blister card is in a first position;

a receiver for securing the blister card in the first position; and an electronics module that is configured to:

(1) perform a first comparison between a first state of the monitoring region at a first time and an expected state of the monitoring region at the first time, the expected state being based on the dosing regimen; and (2) generate a first output signal based on the first comparison, wherein the first output signal has a first characteristic when the first comparison indicates compliance with the dosing regimen and a second characteristic when the first comparison indicates non-compliance with the dosing regimen.

23. The system of claim 22 wherein the detection module is configured to monitor the state of the monitoring region by a tomographic technique that is selected from the group consisting of electrical resistance tomography and electrical impedance tomography.

24. The system of claim 22 wherein the detection module is configured to monitor the state of the monitoring region by a sensing technique selected from the group consisting of capacitive, optical, acoustic, and tactile sensing.

25. The system of claim 22 wherein the electronics module is operative for:

determining a first geolocation of the user at a second time;

determining a second geolocation of the detection module at the second time;

determining a risk for future non-compliance based on at least the first geolocation, the second geolocation, the second time, and the next dosing window of the sequence thereof; and generating an alert if the risk exceeds a threshold.

26. The system of claim 25 wherein the electronics module is further operative for:

comparing the sequence of dosing windows and an event on a calendar, the event having an event-duration that extends from an event-start time to an event-end time; and generating the alert if at least one dosing window overlaps at least a portion of the event-duration.

27. The system of claim 26 wherein the electronics module is further operative for generating the alert based on a distance between the second geolocation and a third geolocation that corresponds to the event.

28. The system of claim 25 wherein the first geolocation is based on a third geolocation of a device that is electronically paired with system.

29. The system of claim 22 wherein the electronics module is operative for providing remediation guidance to the user when the first comparison indicates non-compliance with the dosing regimen.

30. The system of claim 22 wherein the electronics module is operative for providing an exhaustion warning that is based on the first comparison.

31. The system of claim 22 further comprising a display that includes at least one of a visual indicator, an audible indicator, and an alphanumeric display.

32. The system of claim 22 wherein the receiver includes a frame that has (1) an unclamped orientation that enables motion of the blister card relative to the detection module and (2) a clamped orientation that enables the frame to secure the blister card in the first position.

33. The system of claim 32 wherein the frame has a curvature in at least one dimension when the frame is in its unclamped orientation, and wherein, when the frame is in its clamped orientation and the blister card is in the first position, the curvature is reduced by a force that exists between the frame and the blister card.

34. The system of claim 33 wherein the force is substantially evenly distributed over the area of the frame.

35. The system of claim 32 wherein the receiver further includes a friction layer that is configured to inhibit a change in the positional relationship between the blister card and the detection module when the blister card is in the first position and the frame is in its clamped position.

* * * * *